US009897962B2

(12) United States Patent
Osada

(10) Patent No.: US 9,897,962 B2
(45) Date of Patent: Feb. 20, 2018

(54) SHEET PROCESSING DEVICE AND IMAGE FORMING APPARATUS PROVIDED WITH THE SAME

(71) Applicant: Hisashi Osada, Minamikoma-gun (JP)

(72) Inventor: Hisashi Osada, Minamikoma-gun (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 207 days.

(21) Appl. No.: 14/942,269

(22) Filed: Nov. 16, 2015

(65) Prior Publication Data

US 2016/0154363 A1 Jun. 2, 2016

(30) Foreign Application Priority Data

Nov. 28, 2014 (JP) ..... 2014-241045
Nov. 28, 2014 (JP) ..... 2014-241046

(51) Int. Cl.

*B65H 45/04* (2006.01)
*G03G 15/00* (2006.01)
*B31F 1/00* (2006.01)
*B65H 45/18* (2006.01)

(52) U.S. Cl.

CPC ..... *G03G 15/6582* (2013.01); *B31F 1/0035* (2013.01); *B65H 45/04* (2013.01); *B65H 45/18* (2013.01); *B65H 2301/4505* (2013.01); *B65H 2301/51232* (2013.01); *B65H 2701/13212* (2013.01); *B65H 2801/27* (2013.01)

(58) Field of Classification Search

CPC ..... B31F 1/0035; B65H 45/04; B65H 2301/51232; B65H 2701/13212
USPC ..... 270/32, 45, 58.07
See application file for complete search history.

(56) References Cited

U.S. PATENT DOCUMENTS 7,431,274 B2 * 10/2008 Kushida ..... B65H 37/06 270/32
7,673,862 B2 * 3/2010 Kushida ..... B65H 37/06 270/20.1
8,201,815 B2 * 6/2012 Sasahara ..... B65H 45/18 270/32
8,459,631 B2 * 6/2013 Ishikawa ..... B42B 4/00 270/32

(Continued)

FOREIGN PATENT DOCUMENTS

JP 4217640 B2 2/2009
JP 4514217 B2 7/2010

(Continued)

*Primary Examiner* — Leslie A Nicholson, III
(74) *Attorney, Agent, or Firm* — Manabu Kanesaka

(57) ABSTRACT

A sheet pressing device of the present invention includes: a pair of pressing rollers 70 that press, in a fold thickness direction, a fold of a folded sheet bundle BS conveyed in a folded state; and a pressing roller unit 56 that moves the pressing roller pair in a sheet fold direction while supporting the same. The pressing roller pair 70 presses the fold in one of a first region R1 where rollers of the pressing roller pair 70 are brought into pressure contact with each other and a second region R2 adjacent to the first region R1 on an upstream side thereof where rollers of the pressing roller pair 70 are opposed to each other at an interval. With this configuration, it is possible to minimize damage on a sheet end portion and reduce a moving load of the pressing roller pair 70.

18 Claims, 23 Drawing Sheets

(56) References Cited

U.S. PATENT DOCUMENTS 8,596,631 B2 * 12/2013 Ishikawa ..... B42B 4/00
270/32

FOREIGN PATENT DOCUMENTS

JP 2012-201462 A 10/2012
JP 2014-076903 A 5/2014

* cited by examiner

SHEET PROCESSING DEVICE AND IMAGE FORMING APPARATUS PROVIDED WITH THE SAME

BACKGROUND OF THE INVENTION

Field of the Invention

The present invention relates to a sheet processing device that folds a sheet bundle formed by sheets that are sequentially carried out from an image forming device such as a copier or a printer and accumulated in a bundle and, more particularly, to a sheet processing device that performs processing for preventing the folded sheet bundle from being opened after discharge by pressing a fold of a folded sheet bundle while preventing damage of a sheet end portion and deviation of the folded sheet bundle from a proper position.

Description of the Related Art

There are widely known processing devices that align sheets carried out from an image forming device and staple them, or fold them into a booklet. Among them, some processing devices are configured to saddle-stitch the sheet bundle with a staple or an adhesive and fold the sheet bundle into a booklet. Such a device performs folding sheet bundle formed by 2 or 3 sheets to about 30 sheets in two; however, there may be a case where the two-folded sheet bundle is unintentionally opened after being discharged from the device, degrading aligning property of the sheet bundle, which results in reduction in accumulation amount.

Thus, as processing to cope with this problem, it is widely known that the fold of the two-folded sheet bundle that has once been subjected to folding is subjected to pressing from front and back sides thereof.

For example, as illustrated in FIG. 21, Japanese Patent No. 4,514,217 discloses a device that presses from above and below the fold of a folded sheet bundle BS by means of a pressing roller moving along the fold. The pressing roller is a pair of pressing rollers 361*a* and 361*b*. The pressing roller pair 361*a* and 361*b* are supported by a holder 362 and moved thereby along a fold direction F. With this configuration, the folded sheet is prevented from being opened after discharge.

Further, as illustrated in FIGS. 22A and 22B, Jpn. Pat. Appln. Laid-Open Publication No. 2012-201462 disclose a device in which two pressing roller pairs 461 and 463 are provided in a holder 462 that is moved along the fold of the sheet bundle. The pressing roller pair 461 is long in a sheet conveying direction and the processing roller pair 463 is short in the sheet conveying direction. In this device, depending on the number of sheets forming the sheet bundle, a position of the fold of the sheet bundle is moved forward and backward. When the number of sheets is small, the fold is pressed only by the long roller pair, and when the number of sheets is large, both the long and short pressing roller pairs 461 and 463 are used to press twice the fold. Thus, when the number of sheets is large, the fold is pressed at two positions and thereby strengthened.

As another embodiment, there is disclosed a configuration in which one of pressing roller pairs disposed in the fold direction is designed such that opposing rollers can be moved in a direction separating from each other. That is, when the number of sheets is large, the fold is pressed by the pressing roller pairs of two rows; on the other hand, when the number of sheets is small, the fold is pressed only by the pressing roller pairs of one row.

Further, as illustrated in FIGS. 23A and 23B, Jpn. Pat. Appln. Laid-Open Publication No. 2014-76903 discloses a processing device provided with a pair of pressing rollers 561*a* and 562*a* that press the fold of a two-folded sheet bundle in a sheet thickness direction and a holder 560 that reciprocates the pressing roller pair in a sheet width direction. Further, the processing device is configured to move the rollers of the pressing roller pair between a position where they are separated away from each other and a position where they are brought into pressure contact with each other. Upon re-folding the sheet bundle, the holder 560 is moved inward of the sheet bundle from an end portion thereof in the sheet width direction with the rollers of the pressing roller pair separated away from each other, as illustrated in FIG. 23A. After the holder 560 is moved inward, the rollers of the pressing roller pair are brought into pressure contact with each other to press one side of the sheet bundle. After the holder 560 passes through one end portion of the sheet bundle, the pressure contact state between the pair of pressing rollers are released to separate the rollers of the roller pair from each other and, when the holder 560 is moved toward the other side, the pressing roller pair is made to pass through the end portion of the sheet bundle in the separated state. Thereafter, the rollers of the pressing roller pair are brought into pressure contact with each other once again to press the other side of the sheet bundle. In other words, the pressing against the fold of the sheet bundle is started from the inside of the sheet bundle in the sheet width direction to the end portion thereof.

The above-described devices that perform pressing against the fold of the folded sheet bundle carried out from an image forming device or the like have the following problems.

In the device disclosed in Japanese Patent No. 4,514,217, the pair of pressing rollers 361*a* and 361*b* are moved inward from the sheet bundle end portion in the sheet width direction in the pressure contact state, so that the rollers collide with an end portion 371 of the sheet bundle, with the result that the sheet may be torn or damaged due to pressing. In addition, the collision may cause the sheet bundle to be inclined, so that a large holding mechanism is required for preventing the inclination. In particular, in this invention, a support fulcrum of the pair of pressing rollers 361*a* and 361*b* is positioned at a downstream side of the holder 362 in the moving direction, so that when the rollers collide with the end portion 371 of the sheet bundle, they are applied with a mutually approaching (closing) direction force, which increases impact on the sheet end portion.

In the device disclosed in Jpn. Pat. Appln. Laid-Open Publication No. 2012-201462, the position of the sheet bundle is changed depending on the number of sheets forming the sheet bundle BS. That is, when the number of sheets is small, the fold is pressed only by the long roller pair 461, and when the number of sheets is large, both the long and short pressing roller pairs 461 and 463 are used to press twice the fold. However, also in this case, the rollers of the pressing roller pairs 461 and 463 of respective rows are brought into pressure contact with each other, so that when, in particular, the number of sheets is large, the pressing roller pairs 461 and 463 collide with the sheet end portion, with the result that the sheet may be torn or damaged due to pressing. In addition, the collision may cause the sheet bundle to be inclined.

In the device disclosed in Jpn. Pat. Appln. Laid-Open Publication No. 2014-76903, the rollers of the pressing roller pair are separated from each other at a standby position outside the sheet bundle in the sheet width direction. Then, after being moved to the width direction inside of the sheet bundle having the fold in the separated state, the rollers of the pressing roller pair are brought into pressure contact with each other for sheet bundle pressing. When passing through the end portion in the sheet width direction, the rollers are separated from each other, making it possible to suppress the end portion of the sheet bundle from being torn or damaged due to pressing. However, the separation of the rollers is always made irrespective of whether the number of sheets is large or small, a separation mechanism is required, resulting in structural complication. In addition, every time the rollers are returned in its reciprocation, they need to pass through the end portion of the sheet bundle, irrespective of the number of sheets, so that it takes time to complete the pressing processing.

SUMMARY OF THE INVENTION

The present invention has been made in view of the above problems and has a configuration in which a pressing member pair for pressing a fold of a folded sheet bundle has a first region where members thereof are brought into pressure contact with each other and a second region where members thereof are separated from each other. Thus, the folded sheet bundle formed by a small number of sheets is pressed in the first region; while the folded sheet bundle formed by a large number of sheets is pressed in the second region, whereby impact due to collision between the pressing member pair and a sheet end portion can be reduced even when the sheet end portion has a large thickness. Further, since the folded sheet bundle formed by a small number of sheets is pressed in the first region, the fold can surely be pressed.

That is, an object of the present invention is to provide a sheet processing device capable of minimizing damage on the sheet end portion and reducing a moving load of the pressing member pair when the pressing member pair is moved along the fold for pressing, and an image forming apparatus provided with the sheet processing device.

To solve the above problems, there is provided a sheet processing device that presses a fold of a folded sheet bundle, the device including: a pair of pressing members that press, in a fold thickness direction, the fold of the folded sheet bundle conveyed in a folded state; and a moving member that moves the pressing roller pair in a sheet fold direction while supporting the same. The pressing member pair presses the fold in one of a first region where members of the pressing member pair are brought into pressure contact with each other and a second region adjacent to the first region on an upstream side thereof where members of the pressing member pair are opposed to each other at an interval.

With this configuration, the pressing member pair has the first region where members of the pressing member pair are brought into pressure contact with each other and the second region where members of the pressing member pair are opposed to each other at an interval, so that it is possible to reduce impact generated when the pressing member pair abuts against the end portion of the sheet bundle and a moving load of the pressing member pair.

Thus, there can be provided a sheet processing device capable of minimizing damage on the sheet end portion due to collision with the pressing member pair that is moved along the fold for pressing, and an image forming apparatus provided with the sheet processing device.

BRIEF DESCRIPTION OF THE DRAWINGS

FIGS. 11A to 11C are explanatory views illustrating a folded sheet bundle having a plurality of fold lines as a result of stepwise folding performed by the stepwise folding unit of FIGS. 7 to 9, in which FIG. 11A is a view illustrating a state where the folded sheet bundle is pressed between first upper and lower pressing rollers, FIG. 11B is a view illustrating a state where the folded sheet bundle is pressed between second upper and lower pressing rollers, and FIG. 11C is a view illustrating a state where the folded sheet bundle is pressed between third upper and lower pressing rollers;

FIGS. 14A to 14D are views illustrating the pressing roller pairs of a plurality of rows provided in the stepwise folding unit, in which FIG. 14A is a view for explaining stepwise folding for a large number of sheets (equal to or more than a predetermined number of sheets), 14B is a plan view illustrating a state before the stepwise folding of FIG. 14A, FIG. 14C is a view for explaining stepwise folding for a small number of sheets (less than a predetermined number of sheets), 14D is a plan view illustrating a state before the stepwise folding of FIG. 14C;

DESCRIPTION OF THE EMBODIMENTS

Figure 1:
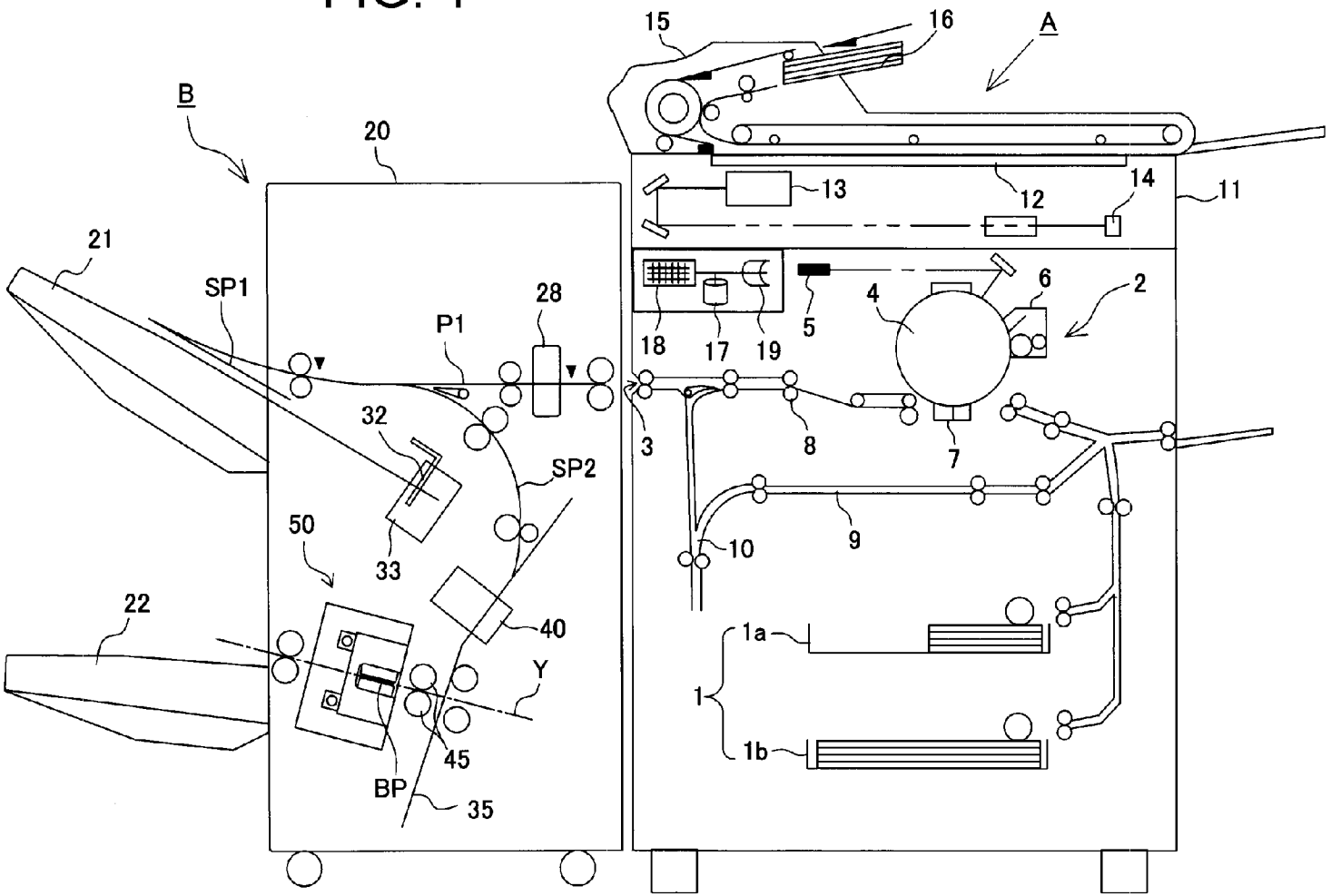
FIG. 1 is an explanatory view illustrating an entire configuration of an image forming system including an image forming apparatus according to the present invention and a sheet processing device incorporating a stepwise folding unit.
Figure 2:
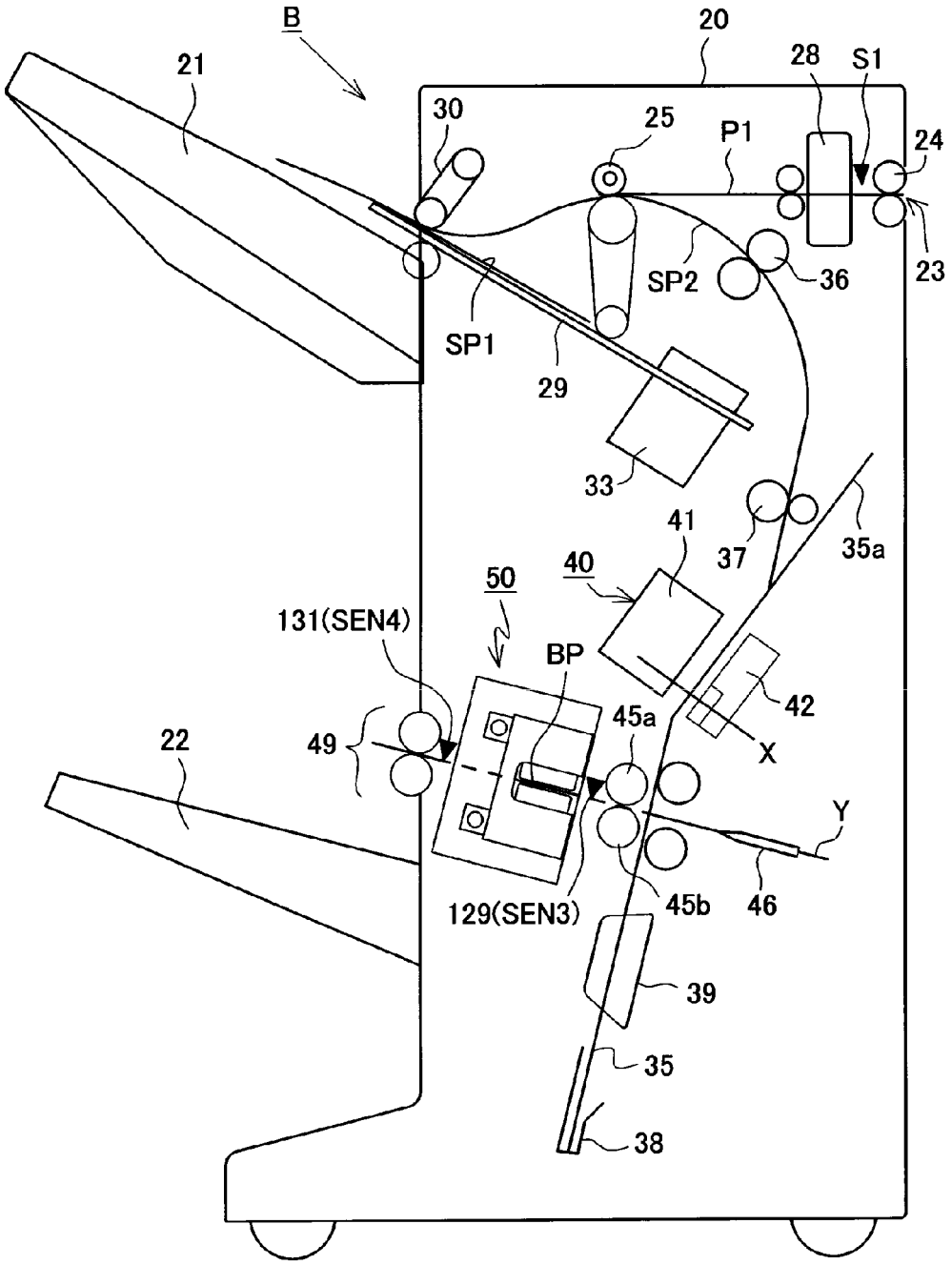
FIG. 2 is an explanatory view of an entire configuration of the sheet processing device incorporating the stepwise folding unit according to the present invention.
Figure 3A:
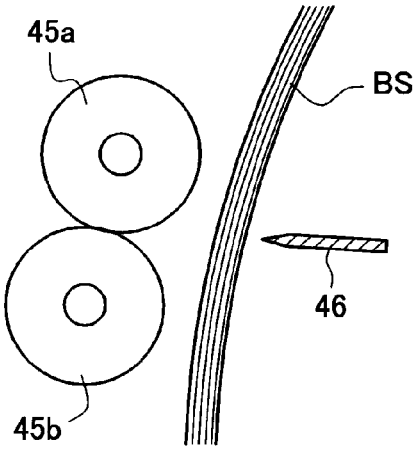
FIGS. 3A to 3D are views explaining folding processing performed by a folding roller in the sheet processing device.
Figure 3B:
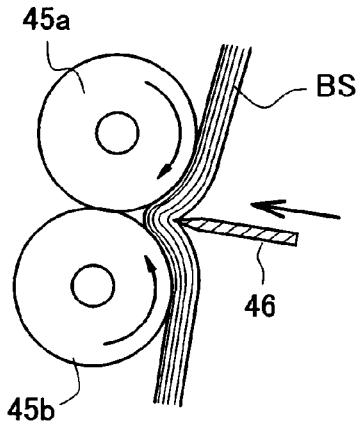
Figure 4:
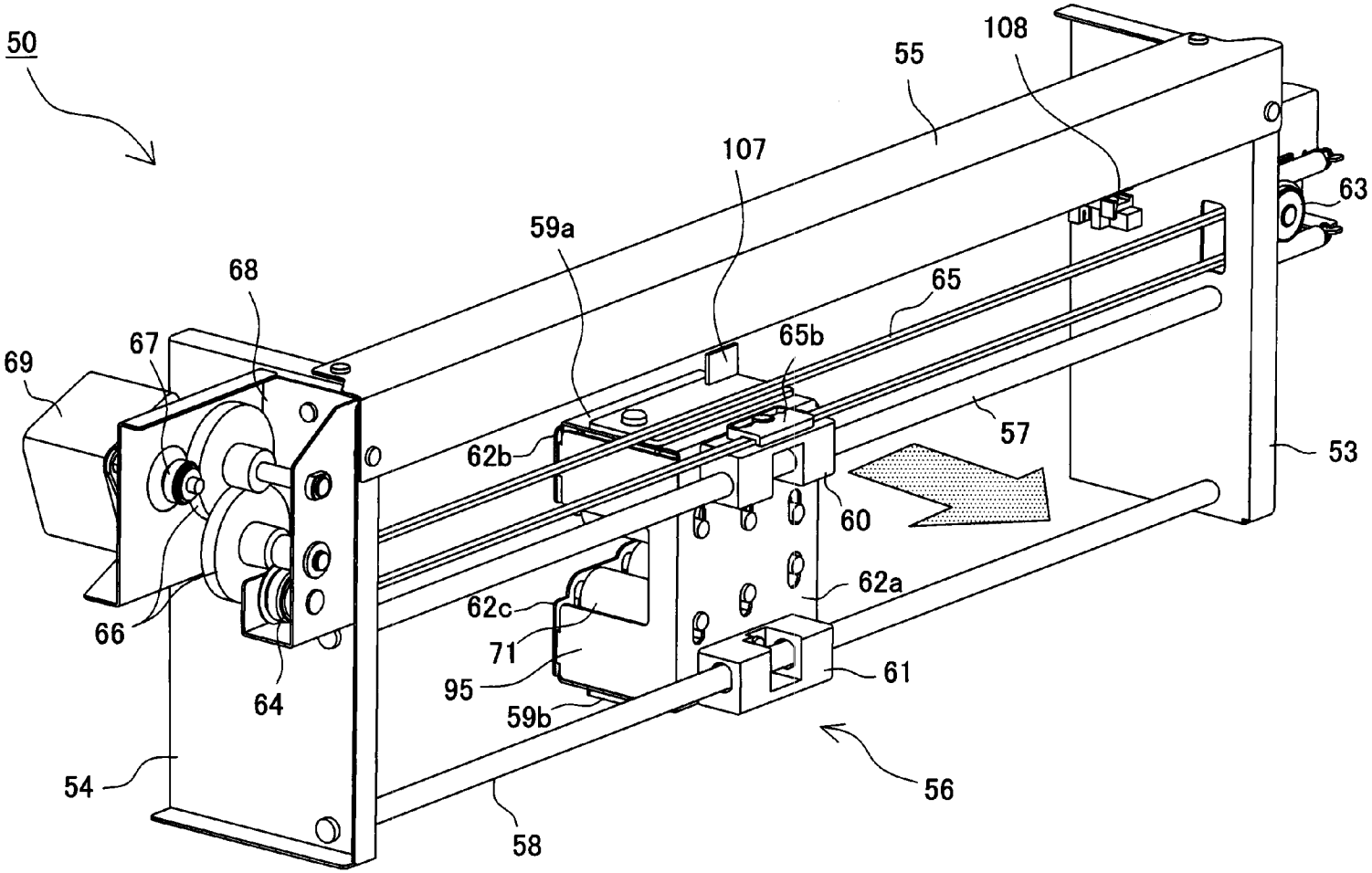
FIG. 4 is a perspective view of the stepwise folding unit of FIG. 2 as viewed from a bundle discharge roller side.
Figure 5:
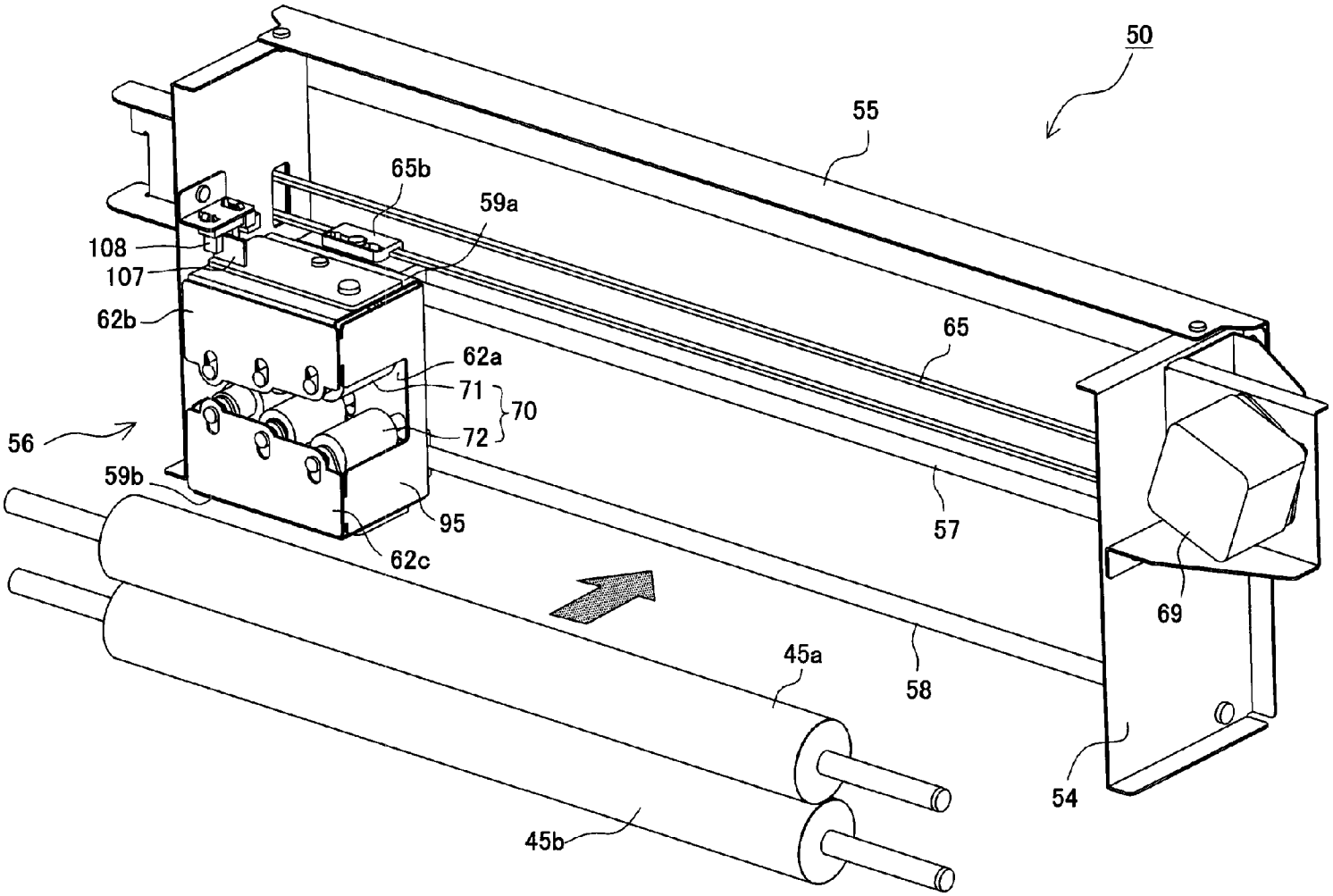
FIG. 5 is a perspective view of the stepwise folding unit of FIG. 2 as viewed from a folding roller side.

Hereinafter, the present invention will be described in detail based on illustrated embodiments. FIG. 1 illustrates an entire configuration of an image forming system including an image forming apparatus according to the present invention, FIG. 2 is an explanatory view of an entire configuration of a sheet processing device, and FIGS. 3A to 3D are views explaining a folded state of a sheet bundle in the sheet processing device. FIG. 4 is a perspective view of a stepwise folding unit incorporated in the sheet processing device and configured to stepwise fold a sheet bundle, as viewed from a discharge side thereof, and FIG. 5 is a perspective view of the stepwise folding unit as viewed from a folding roller side.

The image forming system illustrated in FIG. 1 is constituted by an image forming device A and a sheet processing device B, and a stepwise folding unit 50 is incorporated in the sheet processing device B.

[Configuration of Image Forming Device]

The image forming device A illustrated in FIG. 1 feeds a sheet from a sheet supply section 1 to an image forming section 2, performing printing for the sheet in the image forming section 2, and carries out the resultant sheet from a main body sheet discharge port 3. In the sheet supply section 1, sheets of a plurality of sizes are housed in sheet cassettes 1*a* and 1*b*, and sheets of a designated size are fed to the image forming section 2 while being separated one from another. The image forming section 2 includes, for example, an electrostatic drum 4, a print head (laser emitter) 5, a developing unit 6, a transfer charger 7, and a fixing unit 8. The print head 5, developing unit 6, transfer charger 7, and fixing unit 8 are disposed around the electrostatic drum 4. In this image forming section 2, the laser emitter 5 forms an electrostatic latent image on the electrostatic drum 4, the developing unit 6 makes toner adhere to the obtained electrostatic latent image, the transfer charger 7 transfers an image onto the sheet, and the fixing unit 8 thermally fixes the image to the sheet. The sheets with the thus formed image are sequentially carried out from the main body sheet discharge port 3. A reference numeral 9 is a circulation path for two-sided printing. More specifically, the sheet on a front side of which the image has been printed is fed from the fixing unit 8, reversed in a main body switchback path 10, and made to enter the circulation path 9, along which the sheet is fed once again to the image forming section 2 for printing on a back side of the sheet. The thus two-sided printed sheet is reversed in the main body switchback path 10 and carried out from the main body sheet discharge port 3.

A reference numeral 11 is an image reading device. The image reading device 11 scans a document sheet set on a platen 12 using a scan unit 13, and light reflected from the document and passing through a reflective mirror and a condenser lens is electrically read by a photoelectric conversion element 14. This image data is subjected to, e.g., digital processing in an image processing section, transferred to a data storage section 17, from which an image signal corresponding to the resultant image data is transmitted to the laser emitter 5. A reference numeral 15 is a document feeder that feeds a document sheet housed in a document stacker 16 to the platen 12.

A controller is provided in the image forming device A having the above configuration, and image formation conditions, for example, print-out conditions such as sheet size designation, color/monochrome printing designation, number-of-copies designation, one-sided/two-sided printing designation, and scaling printing designation are set through a controller panel 18. Further, in the image forming device A, image data read by the scan unit 13 or image data transferred from an external network is stored in the data storage section 17. The image data is transferred from the data storage section 17 to a buffer memory 19, from which data signals corresponding to the image data are sequentially transmitted to the laser emitter 5.

Simultaneously with the image forming conditions, sheet processing conditions (post-processing conditions) are input and designated via the control panel 18. For example, (1) "printout mode", (2) "stapling mode", (3) "saddle stitching and folding mode", and (4) "stepwise folding mode" are designated as the post-processing conditions. The image forming device A forms an image on the sheet in accordance with the image forming conditions and the post-processing conditions.

[Configuration of Sheet Processing Device]

The sheet processing device B connected to the above-described image forming device A is configured to receive the image-formed sheet from the main body sheet discharge port 3 of the image forming device A and perform sheet processing according to one of the following modes.

The modes include: (1) A mode in which the image-formed sheet is stored in a first sheet discharge tray 21 ("print-out mode" described above); (2) A mode in which the sheets from the main body sheet discharge port 3 are aligned in a bundle, bound by an end face stapler 33, and stored in the first sheet discharge tray 21 ("stapling mode" described above); (3) A mode in which the sheets from the main body sheet discharge port 3 are aligned in a bundle in a stacker section 35 which is a second processing tray, bound at a portion near a center thereof using a saddle stitching stapler 40, folded into a booklet, and stored in a second sheet discharge tray 22 ("saddle stitching and folding mode" described above); and (4) A mode in which a sheet loop is folded stepwise at a fold of a folded sheet bundle that has been saddle-stitched and folded into a booklet and then stored in the second sheet discharge tray 22 ("stepwise folding mode" described above).

As illustrated in FIG. 2, the sheet processing device B includes, in a casing 20 thereof, the first and second sheet discharge trays 21 and 22 and a sheet carry-in path P1 having a carry-in port 23 connected to the main body sheet discharge port 3. The sheet carry-in port P1 is constituted by a straight line path extending in a substantially horizontal direction. Further, first and second switchback conveying paths SP1 and SP2 are branched from the sheet carry-in path P1, along which the sheet is conveyed in a reverse direction. The first switchback conveying path SP1 is branched from the sheet carry-in path P1 at a path downstream side, and the second switchback path SP2 is branched from the sheet carry-in path P1 at a path upstream side. The first and second switchback conveying paths SP1 and SP2 are distanced from each other.

In such a path configuration, in the sheet carry-in path P1, there are disposed a carry-in roller 24 and a sheet discharge roller 25. The sheet discharge roller 25 is configured to be rotatable in normal and reverse directions. Further, in the sheet carry-in path P1, there is disposed a path switching piece (not illustrated) for guiding the sheet to the second switchback conveying path SP2, and the piece is coupled to an operation section such as a solenoid. Further, the sheet carry-in path P1 has, on the downstream side of the carry-in roller 24, a stamp section that performs stamping on the sheet fed from the carry-in port 23 or a single-sheet punching unit 28 that punches the sheets fed from the carry-in port 23 one by one.

[Configuration of First Switchback Conveying Path SP1]

The first switchback conveying path SP1 disposed on the downstream side (rear end portion of the device) of the sheet carry-in path P1 as illustrated in FIG. 2 is configured as described below. The sheet carry-in path P1 is provided, at its exit end, with the sheet discharge roller 25 and a processing tray 29 on which the sheets fed by the sheet discharge roller 25 are stacked and supported. There is disposed, above the processing tray 29, a normal/reverse rotation roller 30 capable of moving up and down between a position to come into contact with the sheet on the tray and a standby position spaced apart therefrom. The normal/reverse rotation roller 30 is controlled to rotate in a clockwise direction in FIG. 2 when the sheet approaches the processing tray 29 to which the normal/reverse rotation roller 30 is coupled, and to rotate in a counterclockwise direction after a sheet rear end passing through the sheet discharge roller 25 enters the processing tray 29. Thus, the first switchback conveying path SP1 is positioned above the processing tray 29.

Further, the first sheet discharge tray 21 is located downstream of the first switchback conveying path SP1 and is configured to support a leading end of the sheet to be guided to the first switchback conveying path SP1 and the second switchback conveying path SP2.

An end face stapler 33 is disposed at a rear end portion of the processing tray 29 in the sheet discharge direction. The illustrated end face stapler 33 staples a sheet bundle on the processing tray 29 at one or more positions of a rear end edge of the sheet bundle. The staple-bound sheet bundle is discharged onto the first sheet discharge tray 21.

The first switchback conveying path SP1 configured as described above aligns the sheets fed by the sheet discharge roller 25 on the processing tray 29 in the "(2) staple-binding mode" as described above, and the end face stapler 33 staples the sheet bundle at one or more positions of the rear end edge of this sheet bundle. In the "(1) print-out mode", the sheet fed by the sheet discharge roller 25 is not subjected to the switchback, but conveyed along the processing tray 29 and discharged to the first sheet discharge tray 21 by a rotation of the normal/reverse rotation roller 30 in a clockwise direction in FIG. 2.

[Configuration of Second Switchback Conveying Path SP2]

The following describes a configuration of the second switchback conveying path SP2 branched from the sheet carry-in path P1. The second switchback conveying path SP2 is a conveying path for guiding a switchback-conveyed sheet. That is, in a state where the sheet is nipped by the sheet discharge roller 25, rotation of the sheet discharge roller 25 is changed from the normal rotation to the reverse rotation, with the result that the sheet is switchback-conveyed along the switchback conveying path SP2. As illustrated in FIG. 2, the second switchback conveying path SP2 is located in a substantially vertical direction inside the casing 20. A conveying roller 36 is located at an inlet of the second switchback conveying path SP2, and an exit conveying roller 37 is located at an outlet of the second switchback conveying path SP2. A stacker section 35 constituting a second processing tray that aligns and temporarily stacks the sheets fed along the second switchback conveying path SP2 is provided downstream of the second switchback conveying path SP2. The illustrated stacker section 35 includes a conveying guide that transfers the sheet. A saddle stitching stapler 40 and a folding roller 45 are arranged along the stacker section 35. The configurations of these components will be sequentially described below.

[Configuration of Stacker Section]

The stacker section 35 is formed of a guide member that guides the sheet being conveyed. The stacker section 35 is configured such that the sheets are stacked and housed thereon. The illustrated stacker section 35 is connected to the second switchback conveying path SP2 and located in a center portion of the casing 20 so as to extend in the substantially vertical direction. This allows the device to be compactly configured. The stacker section 35 is shaped to have an appropriate size to house maximum sized sheets. In particular, the illustrated stacker section 35 is curved or bent so as to project toward an area in which the saddle stitching stapler 40 and the folding roller 45 (45*a*, 45*b*) to be described later are arranged.

A switchback approaching path 35*a* is connected to a conveying direction rear end of the stacker section 35. The switchback approaching path 35*a* overlaps the outlet end of the second switchback conveying path SP2. This is to allow the leading end of a carried-in (succeeding) sheet fed from the exit conveying roller 37 on the second switchback conveying path SP2 to overlap the rear end of the stacked (preceding) sheets supported on the stacker section 35 to ensure the page order of the stacked sheets. A leading end regulating member (hereinafter, referred to as stopper 38) serving as a stopper that regulates a leading end of the sheet in the conveying direction is located downstream of the stacker section 35. The stopper 38 is supported by a guide rail and the like so as to be movable along the stacker section 35. The stopper 38 is configured to be movable to a position where the sheet is carried in the stacker section 35 by means of a not illustrated shift means, a position where the sheet bundle is bound at a center thereof in the stacking direction, and a position where the sheet bundle is folded by the folding roller 45. Further, an aligning member 39 for aligning the sheets is provided in the middle of the stacker section 35 in the sheet conveying direction. The aligning member 39 presses a side edge of the sheet for alignment every time the sheet is carried-in.

[Saddle Stitching Stapler]

The saddle stitching stapler 40 positioned above the stacker section 35 includes a driver unit 41 and a clincher unit 42 which are arranged opposite to each other with respect to the stacker section 35. The driver unit 41 drives a staple into a sheet bundle. The clincher unit 42 bends leg portions of the driven staple in a direction facing each other. With this configuration, the sheet bundle is bound at a binding position X illustrated in FIG. 2 corresponding to the half of a sheet length. The saddle stitching stapler 40 may perform the binding not only by using a metallic staple, but also by using a paper-made staple, by performing press-bonding (without use of the metallic or paper-made staple), or by forming a cut in the paper sheets (without use of the metallic or paper-made staple).

[Folding Roller]

The following describes a configuration of the folding roller 45. As illustrated in FIG. 2, the folding roller 45 for folding the sheet bundle and a folding blade 46 for inserting the sheet bundle into a nip position of the folding roller 45 are disposed at a folding position Y set on the downstream side of the above-described saddle stitching stapler 40. As illustrated in FIGS. 3A to 3D, the folding roller 45 is constituted by an upper pressure contact roller 45*a* and a lower pressure contact roller 45*b* which are brought into pressure contact with each other. The upper and lower pressure contact rollers 45*a* and 45*b* each have a length slightly longer than the maximum width of the sheet. The rollers of the folding roller pair 45 are biased in the pressure contact direction by a not illustrated compression spring. The folding roller pair 45 is formed of a material, such as rubber, having a comparatively large friction coefficient.

Further, the folding blade 46 configured to be moved toward the pressure contact position of the folding roller pair 45 is disposed so as to be capable of advancing and retreating. After the sheet bundle is saddle-stitched by the saddle stitching stapler 40, the folding blade 46 is moved to push the binding position between the rollers of the folding roller pair 45 to cause the rollers of the folding roller pair 45 to be rotated while being pressed against each other, whereby the saddle-stitched sheet bundle is two-folded. In the middle of the above folding processing, the folding blade 46 is returned to its original position and waits for the next sheet bundle. A movement path along which the folding blade 46 is moved is illustrated as the folding position Y which coincides with the binding position X of the sheet bundle.

Hereinafter, a procedure of folding processing of the stacked sheet bundle or stacked and saddle-stitched sheet bundle will be described using FIGS. 3A to 3D. The sheets are stopped by the stopper 38 and stacked as a sheet bundle. Then, the stopper 38 is moved upward to allow the saddle stitching stapler 40 to saddle-stitch the sheet bundle at about a center position of the sheet bundle in the sheet conveying direction. After the saddle stitching, the stopper 38 supporting the resultant sheet bundle is moved down and stopped at a position where the sheet binding position coincides with a folding position. This state is illustrated in FIG. 3A. This position coincides with the pressure contact position between the upper and lower pressure contact rollers 45*a* and 45*b* constituting the folding roller 45. Thereafter, the upper and lower pressure contact rollers 45*a* and 45*b* are rotated in the same direction by a not illustrated drive motor, and the folding blade 46 is moved so as to be pushed to the pressure contact position. This state is illustrated in FIG. 3B.

Figure 3C:
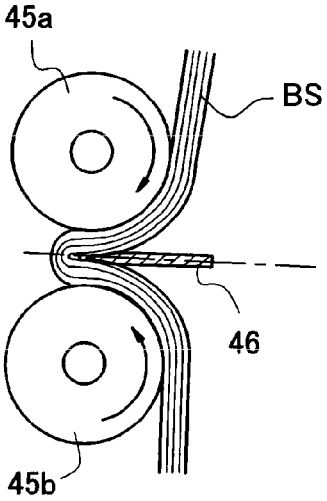
Figure 3D:
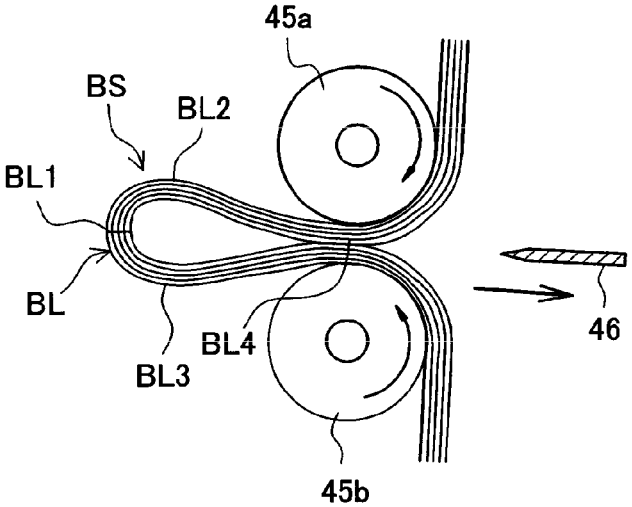

Then, as illustrated in FIG. 3C, the upper and lower pressure contact rollers 45*a* and 45*b* continue being rotated in the same direction, while the folding blade 46 is once stopped before the pressure contact position. Then, the folding blade 46 is retracted in a returning direction. Afterward, when the upper and lower pressure contact rollers 45*a* and 45*b* are further rotated in the same direction, a folded sheet bundle BS to be folded is folded while forming a certain loop BL as illustrated in FIG. 3D. In this state, there are formed a folding loop leading end BL1 which is a fold formed as a result of pushing of the folding blade 46, an upper loop BL2 swelling upward with the folding loop leading end BL1 as a center, a lower loop BL3 swelling downward, and a loop base end portion BL4 that presses the sheets so as to maintain the loop, and the folding operation is once stopped.

The loop at the fold is generated due to action of the sheet bundle to be opened outward. Thus, the larger the number of the sheet bundle BS to be folded, the greater the force of the sheet bundle itself to be opened and spread. Accordingly, if no countermeasure is taken, a discharged sheet bundle is opened. So, in the present invention, the following stepwise folding in which the sheet bundle is subjected to stepwise folding is performed.

The folding roller 45 may be used for detecting a thickness of the sheet bundle BS to be folded. That is, by measuring a distance between axes of the upper and lower pressure contact rollers 45*a* and 45*b* in a state where the sheet bundle BS is not inserted and a distance therebetween in a state where the sheet bundle BS is inserted, the thickness of the folded sheet bundle BS can be detected. This point will be described later using FIG. 13.

[Stepwise Folding Unit]

Figure 6:
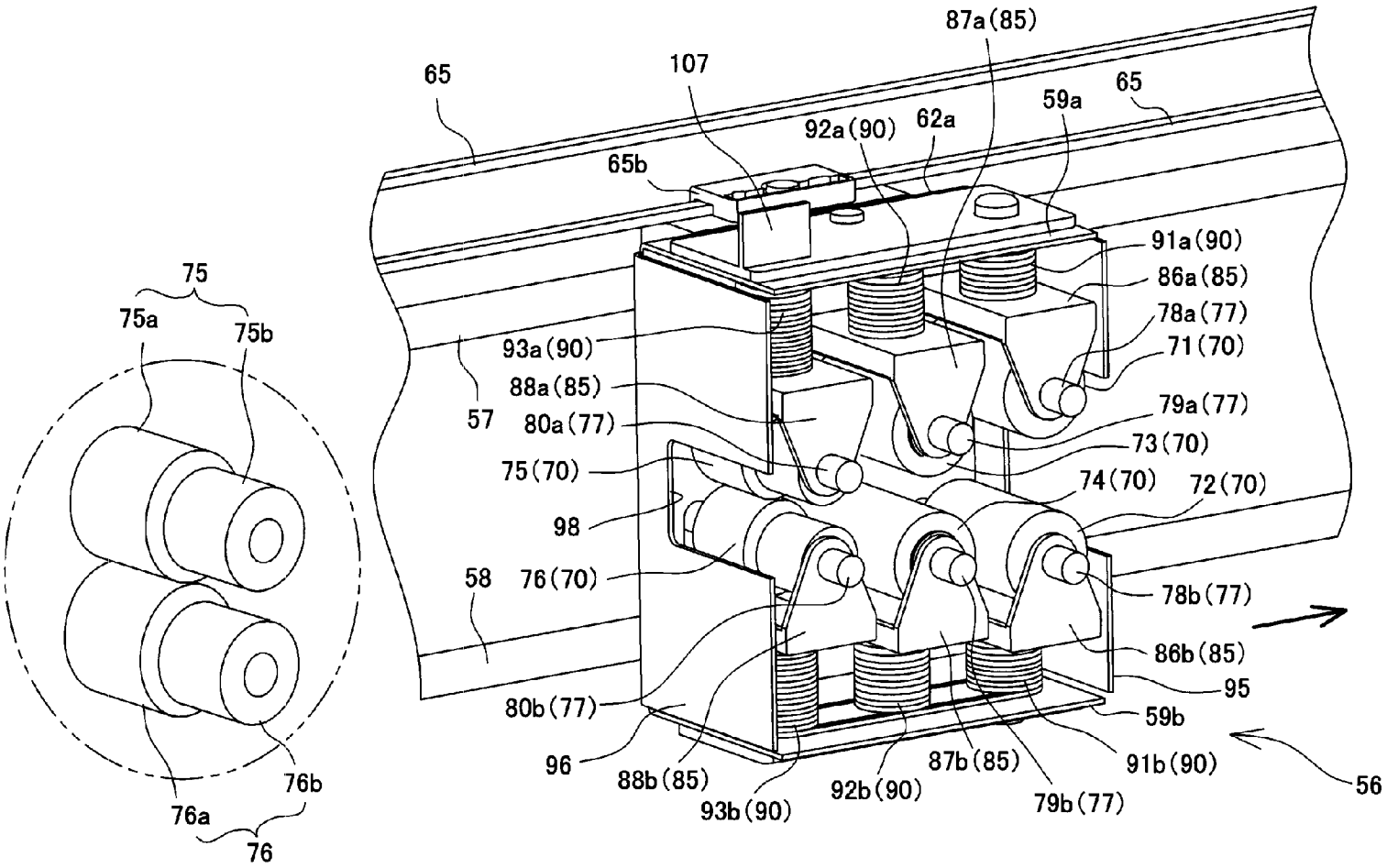
FIG. 6 is an explanatory view illustrating an inside of the stepwise folding unit of FIG. 4.
Figure 7:
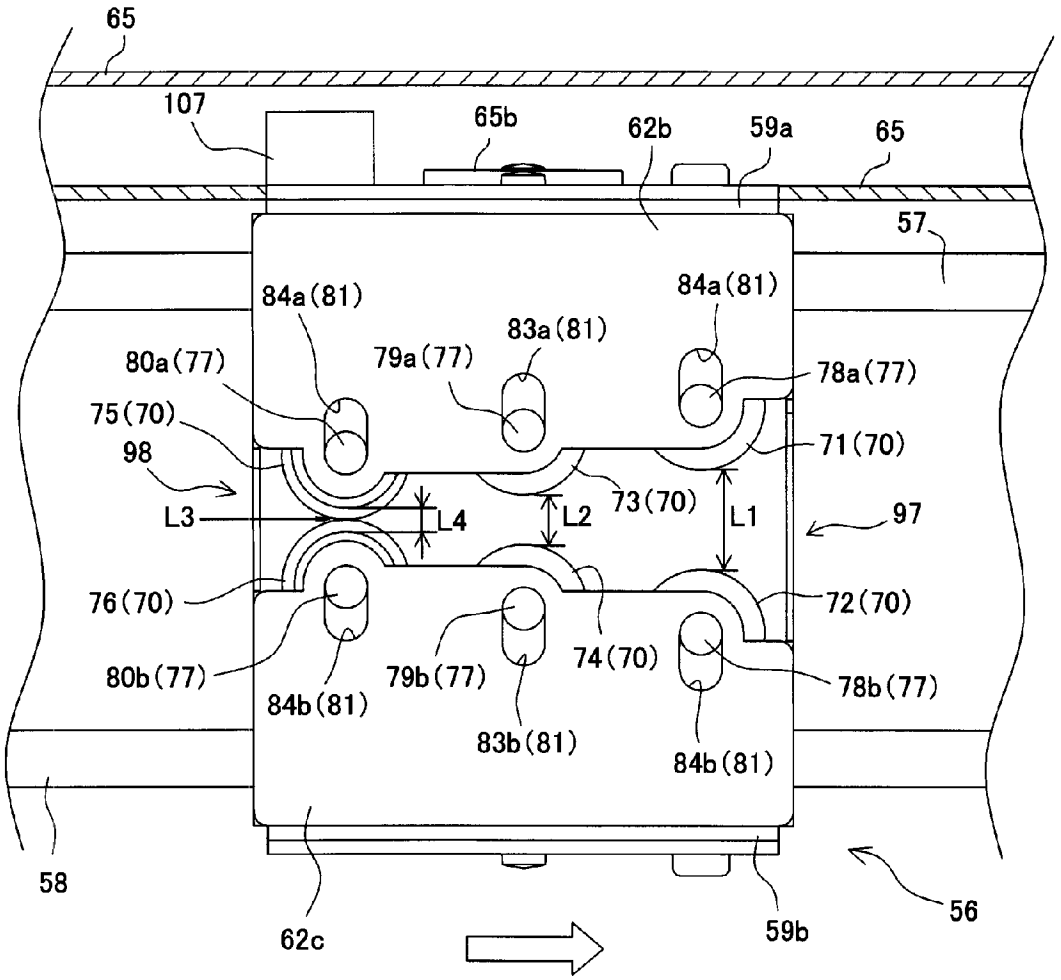
FIG. 7 is a front view of the stepwise folding unit of FIG. 4 as viewed from the folding roller side.

Hereinafter, a stepwise folding unit 50 constituting a part of the sheet processing device according to the present invention will be described. The stepwise folding unit 50 is a unit for preventing the folded sheet bundle BS from being opened. FIG. 4 is a perspective view of the stepwise folding unit 50 as viewed from the sheet discharge side, FIG. 5 is a perspective view thereof as viewed from the folding roller 45 side. Further, a configuration of a pressing roller unit 56 will be described using FIGS. 6 and 7. FIG. 6 is a perspective view of the pressing roller unit 56 as viewed from the folding roller 45 side, and FIG. 7 is a front view thereof. Further, operation of the stepwise folding unit 50 will be described using FIGS. 8 to 10.

As illustrated in FIG. 2, the stepwise folding unit 50 is disposed so as to cross a folded sheet conveying path BP installed downstream of the folding roller 45. More in detail, in the stepwise folding unit 50, the sheet bundle BS folded by the folding roller 45 is pressed by a plurality of pressing roller pairs 70 having mutually different intervals as additional folding processing. The stepwise folding unit 50 faces the fold of the folded sheet bundle BS having the fold in the sheet width direction and a certain loop.

There are disposed, before and after the stepwise folding unit 50 of FIG. 2, a sheet bundle detection sensor (SEN3) 129 and a bundle discharge sensor (SEN4) 131, respectively. The sheet bundle detection sensor 129 detects a back and a fore edge of the sheet bundle folded by the folding roller 45 and then conveyed. The bundle discharge sensor 131 detects discharge of the folded sheet bundle BS from the bundle discharge roller 49.

The stepwise folding unit 50 illustrated in FIG. 2 is installed between the folding roller 45 and the bundle discharge roller 49 as a discharge member that discharges the folded sheet bundle BS outside the device; alternatively however, the stepwise folding unit 50 may be disposed downstream of the bundle discharge roller 49 as long as it crosses the folded sheet conveying path BP.

As illustrated in FIG. 4, in the stepwise folding unit 50, a right side plate 53 disposed at one side of the device, a left side plate 54 disposed facing the right side plate 53, and a connecting angle 55 connecting the right side plate 53 and the left side plate 54 constitute the entire frame of the device. A pressing roller unit 56 is disposed between the right side plate 53 and left side plate 54 as a moving unit that is reciprocated therebetween. The pressing roller unit 56 configured to be reciprocated is slidably moved along an upper guide rail 57 and a lower guide rail 58 extending between the right side plate 53 and the left side plate 54. More specifically, the pressing roller unit 56 is supported such that an upper slide block 60 attached to an upper portion of the pressing roller unit 56 is slid along the upper guide rail 57 and a lower slide block 61 attached to a lower portion of the pressing roller unit 56 is slid along the lower guide rail 58.

A moving belt 65 is provided above the pressing roller unit 56 so as to be stretched between the right side plate 53 and the left side plate 54. A right pulley 63 that winds the moving belt 65 is provided at the right side plate 53 side, and a left pulley 64 that winds the moving belt 65 is provided at the left side plate 54 side. One end of the moving belt 65 is fixed to a belt fixing portion 65*b* at an upper end of the pressing roller unit 56. Thus, when the moving belt 65 is moved to move the belt fixing portion 65*b* from a device back side (right side) to a device front side (left side), the pressing roller unit 56 is moved from the device back side (right side) to the device front side (left side) along the upper guide rail 57 and the lower guide rail 58. When the moving belt 65 is moved in the opposite direction, the belt fixing portion 65*b* is also moved in the opposite direction, which moves the pressing roller unit 56 in the opposite direction.

The left pulley 64 that winds the moving belt 65 is mounted to a motor gear unit 68 provided on the left side plate 54 and connected to a drive motor 69 configured to be rotatable in normal and reverse directions through the motor gear unit 68. Rotation drive of the drive motor 69 is transmitted from a motor output gear 67 to a transmission gear 66 provided in the motor gear unit 68, and then to the left pulley 64 of the moving belt 65.

Thus, selecting a rotating direction of the drive motor 69 allows the pressing roller unit 56 to be moved selectively in the directions from the device back side (right side) to the device front side (left side) and from the device front side (left side) to the device back side (right side). A unit flag 107 is provided near a right side plate 53 side end portion on an upper surface of the pressing roller unit 56. The unit flag 107 indicates that the pressing roller unit 56 is situated at a home position near the right side plate 53. When the unit flag 107 is detected by a home position sensor 108, it can be determined that the pressing roller unit 56 is situated at the home position.

When the pressing roller unit 56 is moved to the left in FIG. 4 from the home position, a position of the pressing roller unit 56 is discriminated by a not illustrated pulse generator incorporated in the drive motor 69, whereby it is determined that the pressing roller unit 56 is situated at a returning position near the left side plate 54. When the pressing roller unit 56 is situated at the returning position, the drive motor 69 is rotated in the reverse direction to move the pressing roller unit 56 toward the home position. Thus, the pressing roller unit 56 is a moving member that is moved by means of the moving belt 65 and the like.

[Pressing Roller Unit]

The following describes the pressing roller unit 56 configured to be moved to the left and right in FIG. 4. As illustrated in FIG. 5, which is a perspective view as viewed from the folding roller 45 side, the pressing roller unit 56 is surrounded by a unit base plate 62*a* constituting a back surface side of the unit, front upper and lower base plates 62*b* and 62*c* which are separated up and down, a preceding unit side plate 95, a following unit side plate 96, a unit top plate 59*a*, and a unit bottom plate 59*b*. The preceding unit side plate 95 has a preceding side plate opening 97 having a comparatively large size, and the following unit side plate 96 has a following side plate opening 98 having a size smaller than the preceding side plate opening 97. These openings 97 and 98 allow the pressing roller unit 56 to be moved along the fold of the folded sheet bundle BS with the fold inserted into the pressing roller unit 56.

As illustrated in detail in FIG. 6, inside the pressing roller unit 56, three rows of pressing roller pairs are arranged from the preceding unit side plate 95 side toward the following unit side plate 96. An interval between the pair of pressing rollers 70 differs among the rows. That is, the pressing rollers 70 of a first row includes a first upper pressing roller 71 and a first lower pressing roller 72 which are disposed opposite to each other and spaced apart from each other by a predetermined interval. The first upper and lower pressing rollers 71 and 72 have a first upper pressing roller shaft 78*a* and a first lower pressing roller shaft 78*b*, respectively. The first upper and lower pressing roller shafts 78*a* and 78*b* are supported by a first upper pressing roller bracket 86*a* and a first lower pressing roller bracket 86*b*, respectively. The first upper pressing roller bracket 86*a* is vertically movably supported by the unit top plate 59*a*, and the first lower pressing roller bracket 86*b* is vertically movably supported by the unit bottom plate 59*b*.

Further, a first upper pressing roller pressing spring 91*a* is interposed between the first upper pressing roller bracket 86*a* and the unit top plate 59*a* so as to bias the first upper pressing roller bracket 86*a* and the unit top plate 59*a* in a direction separating them from each other; similarly, a first lower pressing roller pressing spring 91*b* having the same function as the first upper pressing roller pressing spring 91*a* is interposed between the first lower pressing roller bracket 86*b* and the unit bottom plate 59*b*. With this configuration, the first upper pressing roller 71 and the first lower pressing roller 72 are always biased in a direction approaching each other. On the other hand, a first upper pressing roller shaft elongated hole 82*a* is formed in the unit base plate 62*a* and the front upper base plate 62*b* that support the first upper pressing roller shaft 78*a*.

Thus, the biasing force of the first upper pressing roller pressing spring 91*a* is regulated by the first upper pressing roller shaft elongated hole 82*a*, and downward movement of the first upper pressing roller 71 is also regulated by the first upper pressing roller shaft elongated hole 82*a*. Further, the biasing force of the first lower pressing roller pressing spring 91*b* is regulated by a first lower pressing roller shaft elongated hole 82*b*, and upward movement of the first lower pressing roller 72 is also regulated by the first lower pressing roller shaft elongated hole 82*b*. Thus, as illustrated in detail in FIG. 7, an interval L1 between the first upper pressing roller 71 and the first lower pressing roller 72 is always kept constant. In the present embodiment, the interval L1 is set to about 14 mm. Further, the first upper pressing roller pressing spring 91*a* and the first lower pressing roller pressing spring 91*b* are set so as to apply a load of 4.0 kg to the first upper and lower pressing rollers 71 and 72 in a state where the rollers 71 and 72 are brought into contact with each other.

Further, as can be seen well from FIGS. 6 and 7, the pressing roller pair 70 of a second row has the same configuration as that of the pressing roller pair 70 of the first row.

That is, the pressing rollers 70 of the second row includes a second upper pressing roller 73 and a second lower pressing roller 74 which are disposed opposite to each other and spaced apart from each other by a predetermined interval. The second upper and lower pressing rollers 73 and 74 have a second upper pressing roller shaft 79*a* and a second lower pressing roller shaft 79*b*, respectively. The second upper and lower pressing roller shafts 79*a* and 79*b* are supported by a second upper pressing roller bracket 87*a* and a second lower pressing roller bracket 87*b*, respectively. The second upper pressing roller bracket 87*a* is vertically movably supported by the unit top plate 59*a*, and the second lower pressing roller bracket 87*b* is vertically movably supported by the unit bottom plate 59*b*.

Further, a second upper pressing roller pressing spring 92*a* is interposed between the second upper pressing roller bracket 87*a* and the unit top plate 59*a* so as to bias the second upper pressing roller bracket 87*a* and the unit top plate 59*a* in a direction separating them from each other; similarly, a second lower pressing roller pressing spring 92*b* having the same function as the second upper pressing roller pressing spring 92*a* is interposed between the second lower pressing roller bracket 87*b* and the unit bottom plate 59*b*.

With this configuration, the second upper pressing roller 73 and the second lower pressing roller 74 are always biased in a direction approaching each other. On the other hand, a second upper pressing roller shaft elongated hole 83*a* is formed in the unit base plate 62*a* and the front upper base plate 62*b* that support the second upper pressing roller shaft 79*a*. Thus, the biasing force of the second upper pressing roller pressing spring 92*a* is regulated by the second upper pressing roller shaft elongated hole 83*a*, and downward movement of the second upper pressing roller 73 is also regulated by the second upper pressing roller shaft elongated hole 83*a*.

Further, the biasing force of the second lower pressing roller pressing spring 92*b* is regulated by a second lower pressing roller shaft elongated hole 83*b*, and upward movement of the second lower pressing roller 74 is also regulated by the second lower pressing roller shaft elongated hole 83*b*. Thus, as illustrated in detail in FIG. 7, an interval L2 between the second upper pressing roller 73 and the second lower pressing roller 74 is always kept constant. In the present embodiment, the interval L2 is set to about 7 mm. Further, the second upper pressing roller pressing spring 92*a* and the second lower pressing roller pressing spring 92*b* are set so as to apply a load of 4.0 kg to the second upper and lower pressing rollers 73 and 74 in a state where the rollers 73 and 74 are brought into contact with each other.

Further, as can be seen well from FIGS. 6 and 7, the pressing roller pair 70 of a third row has the same configuration as those of the pressing roller pairs 70 of the respective first and second rows, so descriptions of the pressing roller pair 70 of the third row will be omitted here, and only a different point will be described. That is, the first upper and lower pressing rollers 71 and 72 of the first row are separated from each other by the predetermined interval L1 (in the present embodiment, about 14 mm) as illustrated in FIG. 7; similarly, the second upper and lower pressing rollers 73 and 74 of the second row are separated from each other by the predetermined interval L2 (in the present embodiment, about 7 mm). This is because the first upper pressing roller shaft elongated hole 82*a*, the first lower pressing roller shaft elongated hole 82*b*, the second upper pressing roller shaft elongated hole 83*a*, and the second lower pressing roller shaft elongated hole 83*b* serve as an interval regulating member. Thus, by the above elongated holes, the pair of the pressing rollers are position-regulated so as to prevent the interval therebetween from being made smaller than the predetermined interval.

On the other hand, third upper and lower pressing rollers 75 and 76 of the third row are always elastically biased so as to be brought into pressure contact with each other. That is, a third upper pressing roller shaft elongated hole 84*a* and a third lower pressing roller shaft elongated hole 84*b* are formed such that a roller interval L3 is 0. A third upper pressing roller pressing spring 93*a* and a third lower pressing roller pressing spring 93*b* are set so as to apply a load of 4.0 kg to the third upper and lower pressing rollers 75 and 76 at the roller contact position. With this configuration, the stepwise folding is performed while a load exceeding 4 kg is applied to both sides of the fold of the folded sheet bundle BS.

Further, as illustrated in FIG. 6 and in a circle outlined by a long dashed double-short dashed line in FIG. 6, the pair of third upper and lower pressing rollers 75 and 76 have a first region R1 (hereinafter, referred to as "region R1") where an upper pressing roller large-diameter portion 75*a* and a lower pressing roller large-diameter portion 76*a* are brought into pressure contact with each other and a second region R2 (hereinafter, referred to as "region R2") where an upper pressing roller small-diameter portion 75*b* and a lower pressing roller small-diameter portion 76*b* are opposed to each other with a slight interval. The regions R1 and R2 are adjacently arranged from the downstream side to upstream side in this order in the sheet bundle conveying direction. This stepped roller pair is integrally formed as illustrated and is configured to be rotatable. The reason for using the stepped roller pair is to reduce impact between the end portion of the folded sheet bundle BS and the pressing rollers. This point will be described later using FIG. 13.

As described above, the pressing rollers 70 as a sheet pressing member of the present invention include the first, second, and third upper pressing rollers 71, 73, and 75 and first, second, and third lower pressing rollers 72, 74, and 76 which are disposed opposite respectively to the pressing rollers 71, 73, 75. The above pressing rollers 70 of a plurality of rows (in the present embodiment, three rows) are supported by the pressing roller unit 56 unitized as a moving member so as to be movable. Further, the above pressing rollers 70 can be rotated in the moving direction thereof. The pressing rollers 70 are moved along the fold with the first upper pressing roller 71 of the first row and its opposing lower pressing roller 72, the interval between which is largest, in the lead. The interval between the second upper and lower pressing rollers 73 and 74 of the last row but one (in the present embodiment, second row) is made smaller than that between the first upper and lower pressing rollers 71 and 72.

Then, the third upper and lower pressing rollers 75 and 76 of the third row (last row in the moving direction) are configured to press, at the region (R1) corresponding to the large-diameter portions thereof, the folded sheet bundle BS from both sides with a spring force of 4 kg. That is, in the present embodiment, the pressing rollers of the three rows arranged in and supported by one unit are reduced stepwise in the interval from the first row to the last row. The thus configured pressing rollers 70 are moved along the fold of the folded sheet bundle BS while pressing the fold from both sides of the folded sheet bundle BS. Through this process, the stepwise folding is applied to the folded sheet bundle BS. Further, in the above stepwise folding, the pressing rollers of each row are configured to press the folded sheet bundle BS from both sides of the fold with the pressing position set at a substantial center of each roller pair.

[Operation of Stepwise Folding Unit]

Hereinafter, carry-in of the folded sheet bundle BS to the pressing roller unit 56 in the stepwise folding unit 50 and stepwise pressing operation of the pressing roller unit 56 will be described with reference to FIGS. 8 to 12.

Figure 8:
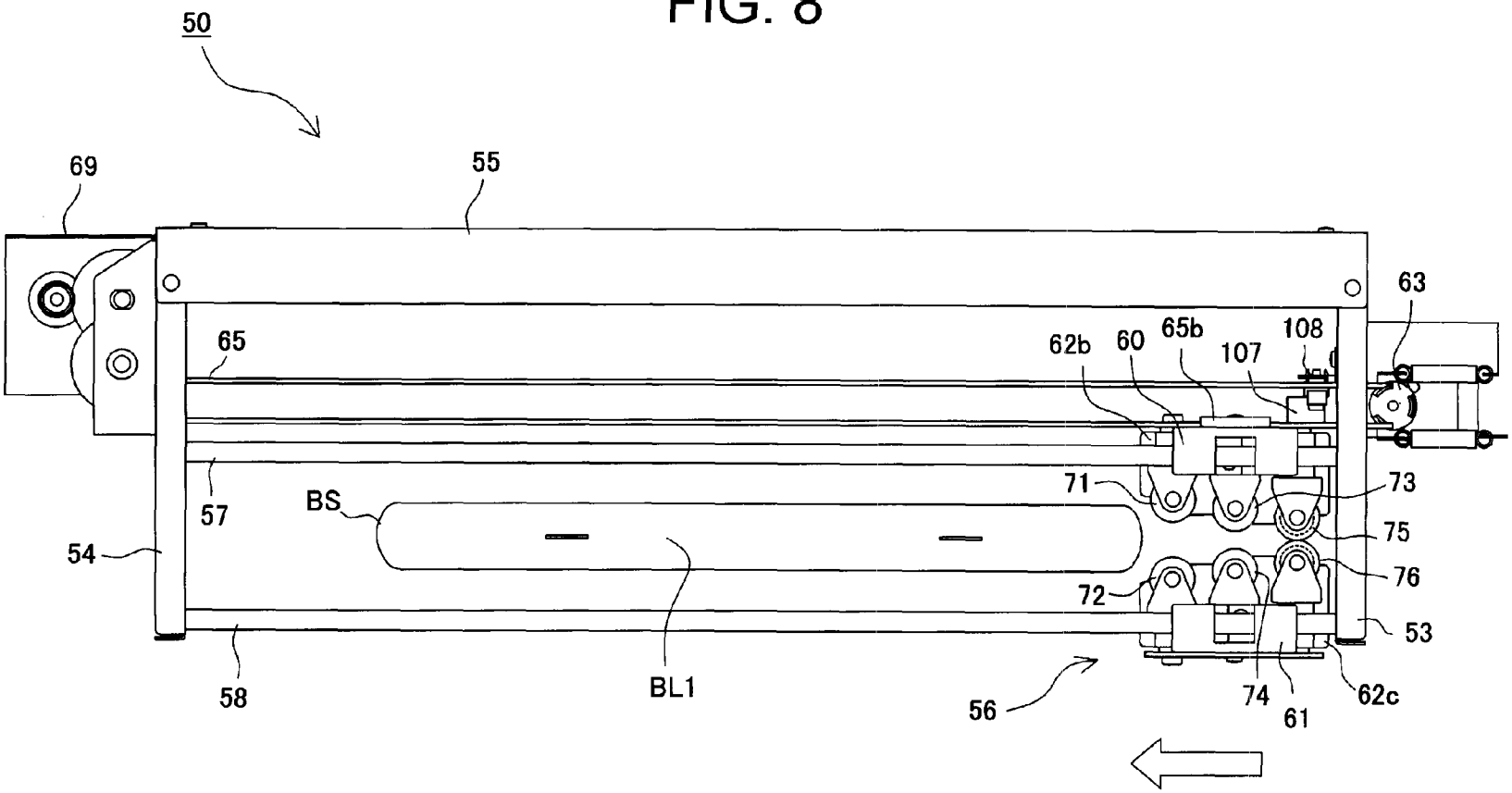
FIG. 8 is a front view illustrating a state where the pressing roller unit illustrated in FIGS. 4 to 7 is situated at a start position.
Figure 9:
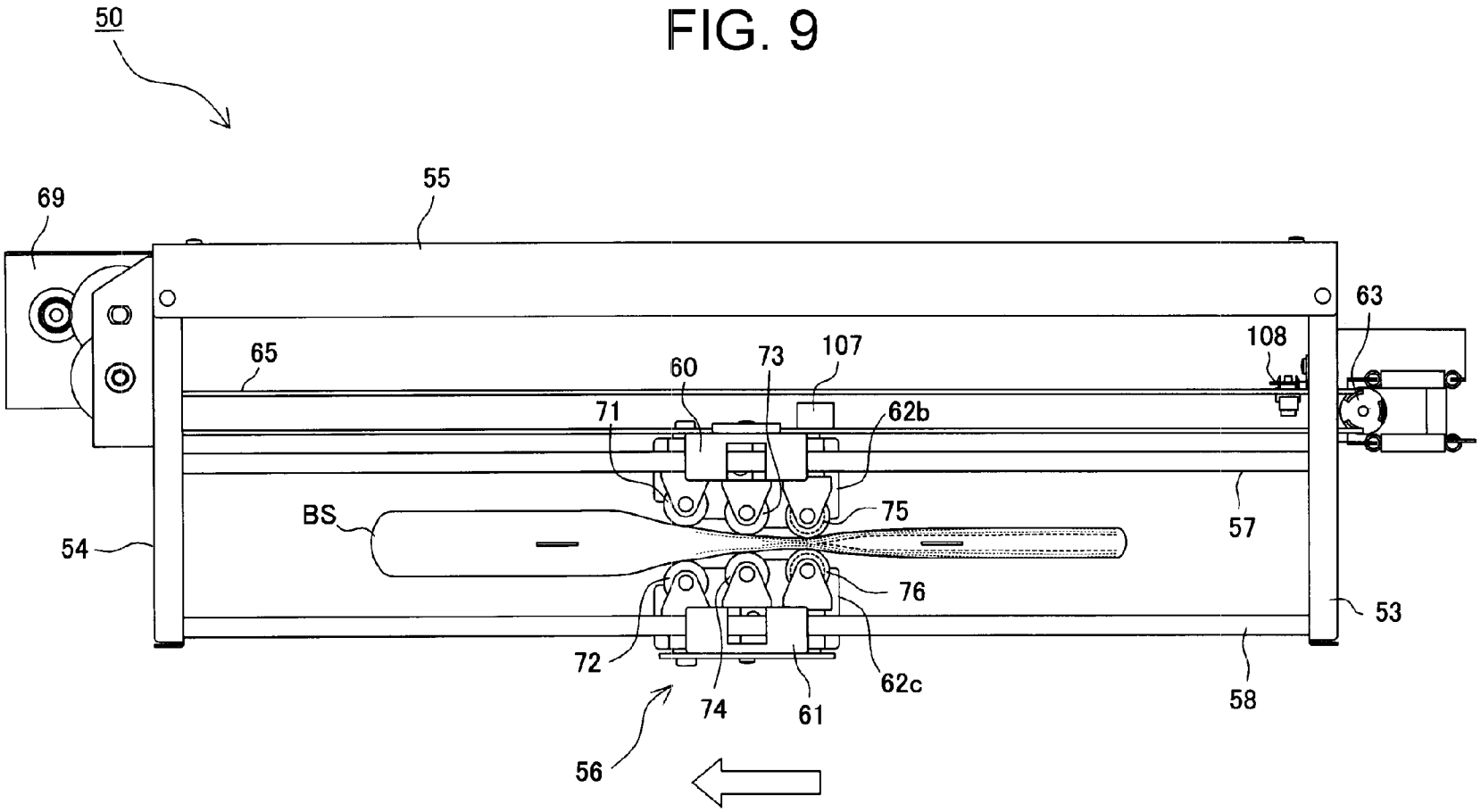
FIG. 9 is a front view illustrating a state where the pressing roller unit illustrated in FIGS. 4 to 7 is moved in the middle of the folded sheet bundle in a width direction thereof.
Figure 10:
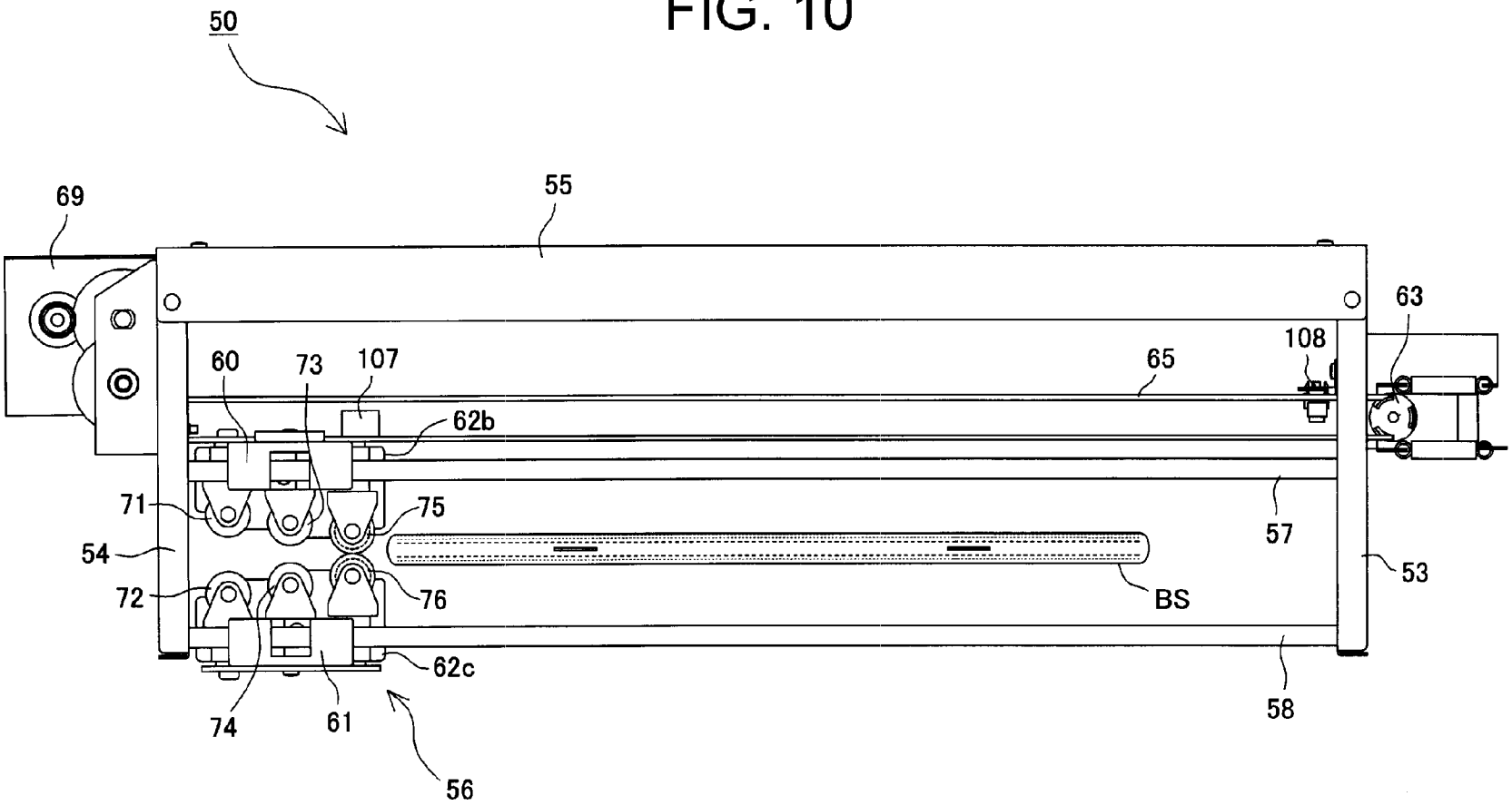
FIG. 10 is a front view illustrating a state where the pressing roller unit illustrated in FIGS. 4 to 7 is situated at an end position in the width direction.

FIG. 8 illustrates a state where the pressing roller unit 56 is situated at the home position and waits for carry-in of the folded sheet bundle BS. FIG. 9 illustrates a state where the pressing roller unit 56 is situated at a substantial center position of the folded sheet bundle BS in the sheet width direction and performs the stepwise folding using roller pairs of three rows. FIG. 10 illustrates a state where the stepwise folding by the roller pairs of three rows is completed, and the pressing roller unit is situated at a returning position. In the following, basic operation of the stepwise folding will be described. Detailed description of the operation involved with the region R1 between the upper and lower pressing roller large-diameter portions 75*a* and 76*a* and region R2 between the upper and lower pressing roller small-diameter portions 75*b* and 76*b* which are opposed to each other the with a slight interval will be made later using FIG. 13 and omitted here.

FIG. 8 illustrates a state where the pressing roller unit 56 is situated at the home position and waits for carry-in of the folded sheet bundle BS. FIG. 8 is a view as viewed from the bundle discharge roller 49 side, and the unit base plate 62*a* is omitted for descriptive convenience.

In FIG. 8, the unit flag 107 of the pressing roller unit 56 having the pressing rollers 70 of three rows is detected by the home position sensor 108 attached to the right side plate 53, that is, the pressing roller unit 56 is situated at the home position. When the "stepwise folding mode" described above is set at this time, the pressing roller unit 56 waits for carry-in of the folded sheet bundle BS that is subjected to the folding by the folding roller 45 and conveyed along the folded sheet conveying path BP.

In the pressing roller unit 56 situated at the home position, the intervals between the pair of pressing rollers 70 of the respective rows are reduced from the first row toward the last row in the moving direction. That is, the pair of pressing rollers 70 of the last row are brought into pressure contact with each other. As described above, in the present embodiment, the first upper and lower pressing rollers 71 and 72 of the first row are disposed at an interval of about 14 mm, the second upper and lower pressing rollers 73 and 74 of the second row are disposed at an interval of about 7 mm, and the third upper and lower pressing rollers 75 and 76 of the first row are brought into pressure contact with each other in the region R1. A center of the separation and pressure contact between the pair of pressing rollers is set so as to substantially coincide with the folding loop leading end (fold) BL1 which is a center of the folded sheet bundle BS.

When the folding loop of the folded sheet bundle BS becomes a predetermined size (in the present embodiment, 22 mm in the vertical direction of the loop), the folding roller 45 is stopped, and the drive motor 69 is driven to move the pressing roller unit 56 to the left in FIG. 8. When this movement is started, the first upper and lower pressing rollers 71 and 72 of the first row override a right side (one end side) end portion (sheet end portion) of the folded sheet bundle BS and are moved to the left while creating a fold at a position slightly above the folding loop leading end BL1. As described above, the size of the loop in the present embodiment is about 22 mm, and the interval between the first upper and lower pressing rollers 71 and 72 is about 14 mm, so that the first upper and lower pressing rollers 71 and 72 overlap the upper and lower portions of the loop, respectively, each by a length of slightly less than about 4 mm to thereby create a first fold line 100 illustrated in FIG. 11A. Further, since the first upper and lower pressing rollers 71 and 72 are disposed at a large interval, the pressing rollers 71 and 72 can override the end portion of the folded sheet bundle BS without significantly damaging the end portion. Further, the pressing rollers 70 including the first upper and lower pressing rollers 71 and 72 are axially supported in the same direction as the sheet conveying direction so as to be rotatable about this axis, and this rotation makes it easy for the pressing rollers to ride over the end portion of the folded sheet bundle BS.

Figure 11A:
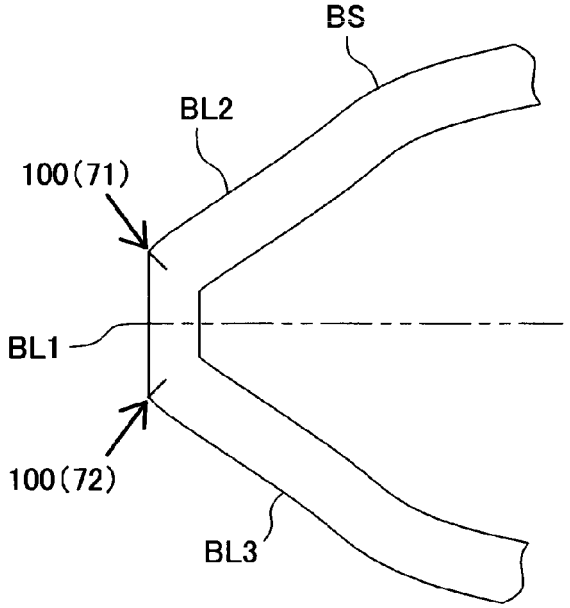
Figure 11B:
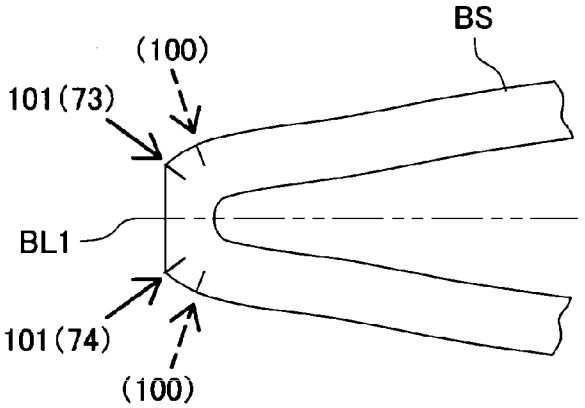

When the pressing roller unit 56 is further moved, the loop of the folded sheet bundle BS pressed between the first upper and lower pressing rollers 71 and 72 is further pressed between the second upper and lower pressing rollers 73 and 74, the interval between which is slightly smaller than the interval between the first upper and lower pressing rollers 71 and 72, whereby a second fold is created. In the present embodiment, the interval between the second upper and lower pressing rollers 73 and 74 is set to about 7 mm, so that the second upper and lower pressing rollers 73 and 74 overlap the respective upper and lower portions of the loop which has been pressed by the first upper and lower pressing rollers 71 and 72, each by a length of about 3.5 mm, whereby a second fold line 101 illustrated in FIG. 11B is added.

Figure 11C:
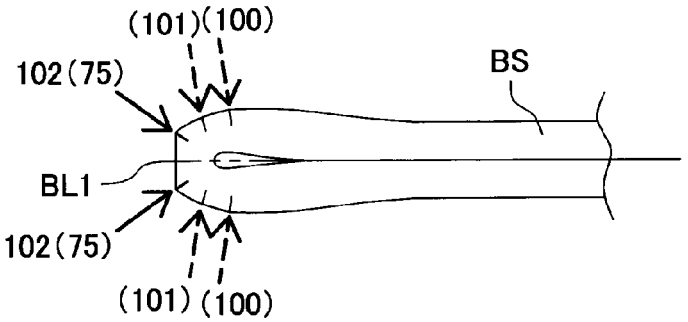

Successively, the folding loop leading end BL1 is subjected to the stepwise folding between the third upper and lower pressing rollers 75 and 76 of the third row. That is, the third upper and lower pressing rollers 75 and 76 are brought into a substantially pressure contact state (region R1 between the large-diameter roller portions) with the interval therebetween set to 0, so that the folded sheet bundle BS are subjected to the stepwise folding while being pressed by the third upper and lower pressing roller pressing springs 93*a* and 93*b* by an amount corresponding to a thickness of the sheet bundle at the fold, whereby a last fold line 102 illustrated in FIG. 11C is added.

FIG. 9 illustrates a state where the pressing roller unit 56 pressing the folded sheet bundle BS stepwise in one unit is situated at a substantial center of the folded sheet bundle BS in the sheet width direction. From this state, the pressing roller unit 56 is further moved to the left in FIG. 9 while adding stepwise folding to the sheet by the pressing roller pairs each having smaller interval in the thickness direction of the fold of the folded sheet bundle BS. In this movement, the third upper and lower pressing rollers 75 and 76 of the third row pass through the right side (one end side) end portion (sheet end portion) of the folded sheet bundle BS to apply the stepwise folding. After passing through the folded sheet bundle BS, the pressing roller unit 56 reaches the returning position at the left side plate 54 side. This state is illustrated in FIG. 10. When the pressing roller unit 56 reaches the returning position, drive of the drive motor 69 is stopped. Thereafter, the pressing roller unit 56 waits for the stepwise-folded sheet bundle BS (folded sheet bundle BS that has pressed by the pressing rollers 70) to be discharged by rotation of the folding roller 45 and the bundle discharge roller 49 in the discharge direction. When a state where the stepwise-folded sheet bundle BS is discharged is detected by the bundle discharge sensor (SEN4) 131 illustrated in FIG. 2, the pressing roller unit 56 is returned from the returning position to home position and made to wait for carry-in of the next folded sheet bundle BS at the position illustrated in FIG. 8.

In the above description, the pressing roller unit 56 is returned to the home position after the stepwise-folded sheet bundle BS of FIG. 10 is once discharged; alternatively, however, the following configuration may be adopted. That is, before discharge of the folded sheet bundle BS, the pressing roller unit 56 is moved from the left to right of FIG. 10 toward the home position to press once again the fold of the folded sheet bundle BS between the third upper and lower pressing rollers 75 and 76, whereby the folded sheet bundle BS can surely be subjected to the stepwise folding by the pressing rollers of the last row.

As described above, in the present embodiment, the pressing roller unit 56 is used to perform the three-step folding for the folded sheet bundle BS. The following describes the folded sheet bundle BS in a state after being subjected to the stepwise folding and discharged with reference to FIGS. 11A to 11C and 12.

Figure 12:
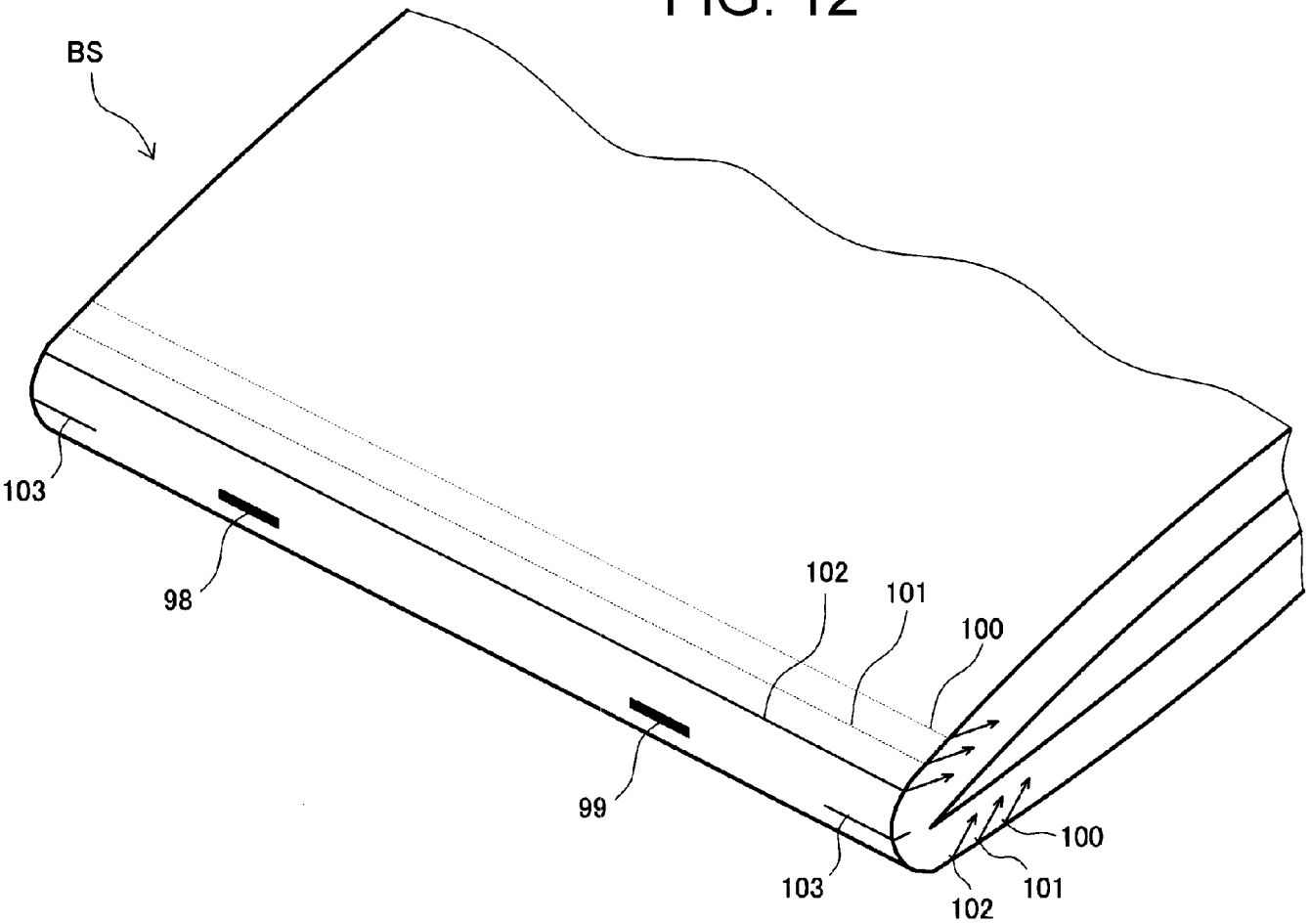
FIG. 12 is a view illustrating a booklet obtained as a result of the stepwise folding of FIGS. 11A to 11C.

As described hereinbefore, the first upper and lower pressing rollers 71 and 72 as the sheet bundle pressing member of the present invention are moved, along the fold direction, on a part of the folded sheet bundle BS where the fold is created by the folding roller 45 and thus the loop is generated while pressing the folded sheet bundle BS in a thickness direction (vertical direction crossing, at the fold of the folded sheet bundle BS, a conveying direction of the folded sheet bundle BS) of the fold to thereby create a plurality of folds. As described above, the interval between the first upper and lower pressing rollers 71 and 72 of the first step is set to a value (in the present embodiments, about 14 mm relative to the loop size (height) of 22 mm) slightly smaller than the loop size, and the first upper and lower pressing rollers 71 and 72 are moved along the fold created by the folding roller 45 to thereby create the first fold. The first fold is illustrated as the first fold line 100 indicated by a solid arrow in FIG. 11A. In FIG. 12, this first fold line 100 is represented by a light line on the folded sheet bundle BS. That is, as illustrated in FIG. 11A, a part of the loop that is pressed by the first upper and lower pressing rollers 71 and 72 is applied with a concentrated load, causing buckling in the sheet bundle to generate the fold. Then, by the movement of the first upper and lower pressing rollers 71 and 72 in the width direction, the buckled part appears as the first fold line 100.

In the second step, the second upper and lower pressing rollers 73 and 74 as the sheet bundle pressing member, the interval between which is set to a value (in the present embodiments, about 7 mm) slightly smaller than the size of the loop pressed in the first step, and the second upper and lower pressing rollers 73 and 74 are moved along the fold created by the folding roller 45 to thereby create the second fold. The second fold is illustrated as the second fold line 101 positioned on a back side of the first fold line 100 and indicated by a solid arrow in FIG. 11B. In FIG. 12, this second fold line 101 is represented by a light line on the folded sheet bundle BS. That is, as illustrated in FIG. 11B, a part of the loop that is pressed by the second upper and lower pressing rollers 73 and 74 is applied with a concentrated load, causing buckling in the sheet bundle to generate the fold. Then, by the movement of the second upper and lower pressing rollers 73 and 74 in the width direction, the buckled part appears as the second fold line 101.

The third upper and lower pressing rollers 75 and 76 as the sheet bundle pressing member of the final step are brought into pressure contact with each other by the elastic force of the third upper and lower pressing roller pressing springs 93*a* and 93*b*. In the final step, unlike the first and second steps, no interval is provided between the third upper and lower pressing rollers 75 and 76 (in the present embodiments, interval is set to 0 in the region R1). Thus, in the final step, the third upper and lower pressing rollers 75 and 76 are moved along the fold while pressing the position corresponding to the thickness of the folded sheet bundle BS that has been pressed in the first and second steps. The fold created by the pressing rollers 70 of the last row is illustrated as a last fold line 102 indicated by a slid arrow in FIG. 11C. In FIG. 12, this last fold line 102 is represented by a comparatively dark line on the folded sheet bundle BS. At end portions of the folded sheet bundle BS in the width direction, end portion folds 103 created when the folding roller 45 and pressing rollers 70, which are brought into a pressure contact state, override the folded sheet bundle BS are formed. A part that is pressed between the third upper and lower pressing rollers 75 and 76, which are brought into a substantially pressure contact state, appears as an enhanced fold, i.e., the last fold line 102.

As described above, the pressing roller pairs 70 having mutually different intervals among the rows are used to buckle the folded sheet bundle BS to create the folds. As a result, a folding direction is directed to a closing direction (line extending in the conveying direction that passes the fold) of the folded sheet bundle BS at the respective positions of the first fold line 100 (indicated by the light line) of the first step, second fold line 101 (indicated by the light line) of the second step, and last fold line 102 (indicated by the comparatively dark line) of the final step generated in accordance with the thickness of the folded sheet bundle BS. With this configuration, it is possible to prevent the folded sheet bundle BS from being opened after discharge to thereby prevent degradation of aligning property and accumulating property.

[Stepped Roller of Last Row]

The following describes a configuration of the stepped third upper and lower pressing rollers 75 and 76 opposite to each other in the last row of the pressing roller unit 56, which has been mentioned in FIGS. 6 and 7.

In a case where the folded sheet bundle BS is formed by a comparatively large number of sheets and is thus thick, when the third upper and lower pressing rollers 75 and 76 which are brought into pressure contact with each other override the end portion of the folded sheet bundle BS in the width direction, they abut against and collide with the end portion to damage the same. Further, when the impact of the collision is large, a position of the folded sheet bundle BS retained by the folding roller 45 may be deviated from a proper position.

Figure 13:
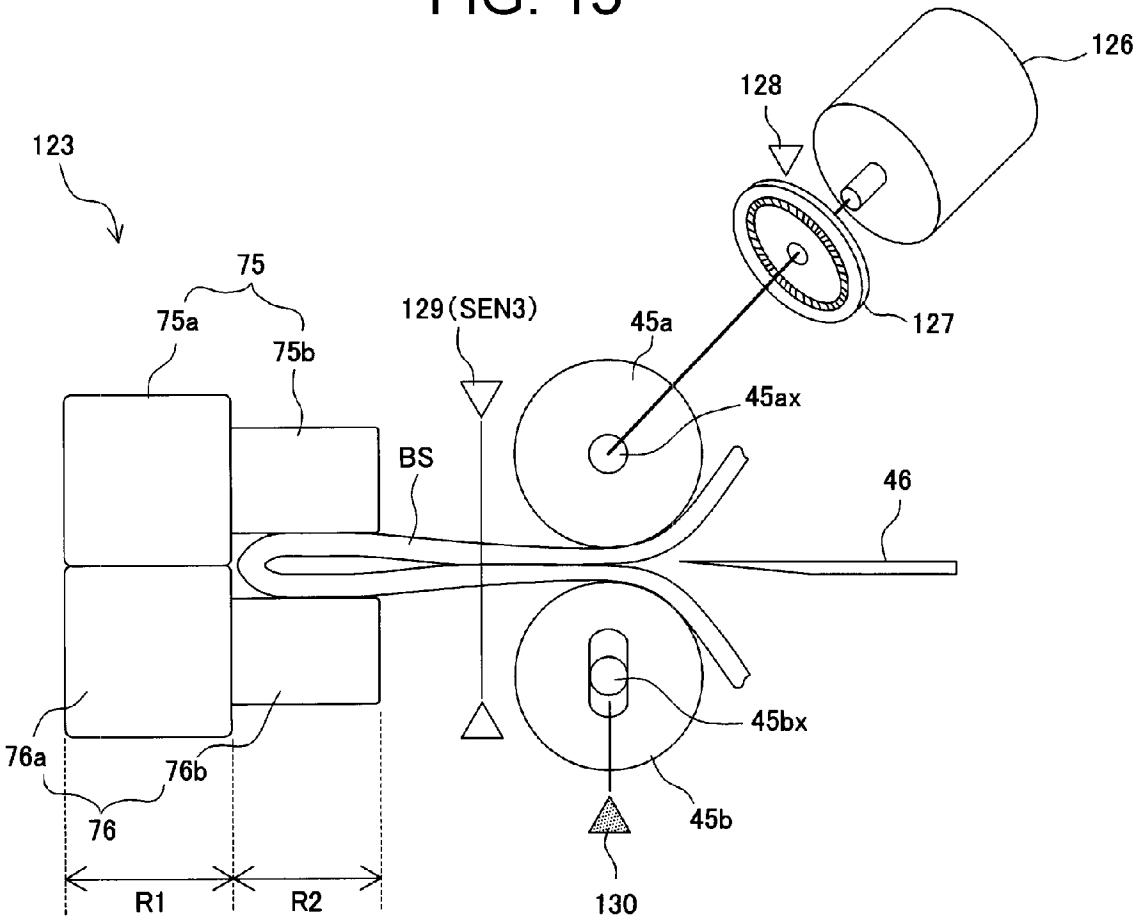
FIG. 13 is a conceptual view for explaining a relationship between final-stage pressing roller pair of the stepwise folding unit and folded sheet bundle.

In order to cope with this problem, in the present embodiment, the third upper pressing roller 75 of the last row includes the upper pressing roller large-diameter portion 75*a* and the upper pressing roller small-diameter portion 75*b* disposed adjacent to the upper pressing roller large-diameter portion 75*a* upstream thereof in the sheet conveying direction, and the third lower pressing roller 76 includes the lower pressing roller large-diameter portion 76*a* and the lower pressing roller small-diameter portion 76*b*, as illustrated in FIGS. 6, 7, and 13. As illustrated in FIG. 6 and in the circle outlined by a long dashed double-short dashed line in FIG. 6, the upper pressing roller large-diameter portion 75*a* and the lower pressing roller large-diameter portion 76*a* constitute the region R1 where they are brought into pressure contact with each other, and the upper pressing roller small-diameter portion 75*b* and the lower pressing roller small-diameter portion 76*b* constitute the region R2 where they are opposed to each other with a slight interval. The upper pressing roller 75 and the lower pressing roller 76 are each integrally formed as a stepped roller.

Thus, as illustrated in FIG. 7, in the region R1 where the upper pressing roller large-diameter portion 75*a* and the lower pressing roller large-diameter portion 76*a* are brought into pressure contact with each other, the interval L3 is 0, while in the region R2, an interval between the upper pressing roller small-diameter portion 75*b* and the lower pressing roller small-diameter portion 76*b* is set to L4 (about 2 mm, in the present embodiment). The interval L4 may be set to about 2 mm to about 4 mm, depending upon the number or a thickness of the sheets to be used. When the number of sheets exceeds a comparative large number (in the present embodiment, 15 sheets (30 sheets in a folded state, which corresponds to about 3 mm or more in thickness)), the fold of the folded sheet bundle BS is positioned to the region R2 between the upper pressing roller small-diameter portion 75*b* and lower pressing roller small-diameter portion 76*b*; on the other hand, when the number of sheets is small (in the present embodiment, 15 sheets or less), the fold of the folded sheet bundle BS is positioned to the region R1 between the upper pressing roller large-diameter portion 75*a* and the lower pressing roller large-diameter portion 76*a* which are brought into pressure contact with each other. With this configuration, the third upper and lower pressing rollers 75 and 76 can easily override even the end portion of the folded sheet bundle BS having a large thickness, thereby reducing damage to the sheet end portion.

[Region Setting for Folded Sheet Bundle]

The following describes, with FIG. 13, a configuration to position the folded portion leading end (back) of the folded sheet bundle BS to the region R1 where the upper and lower pressing roller large-diameter portions 75*a* and 76*a* are brought into pressure contact with each other or the region R2 where the upper and lower pressing roller small-diameter portions 75*b* and 76*b* are opposed to each other with an interval.

As described using FIGS. 3A to 3D, the binding position of the sheet bundle which is positioned at a substantial center thereof in the sheet conveying direction is pushed into between the upper and lower pressure contact rollers 45*a* and 45*b* by the folding blade 46. The pushed folded sheet bundle BS is conveyed toward the pressing rollers 70 by rotation of the upper and lower pressure contact rollers 45*a* and 45*b*. The leading end (back) of the conveyed folded sheet bundle BS is detected by the sheet bundle detection sensor (SEN3) 129 provided between the folding roller 45 and the pressing rollers 70. Upon detection by the sensor SEN3, an encoder 127 mounted to a drive shaft of a folding motor 126 that drives the upper pressure contact roller 45*a* into rotation so as to be rotated integrally therewith is counted by an encoder sensor 128. In a case where the number of the folded sheet bundle BS is small (15 sheets or less, in the present embodiment), the folding motor 126 is stopped at a time point when the count indicates that the fold (back) of the folded sheet bundle BS enters the region R1. On the other hand, in a case where the number of the folded sheet bundle BS is large (16 sheets or more, in the present embodiment), the folding motor 126 is stopped at a time point when the count indicates that the fold (back) of the folded sheet bundle BS enters the region R2. As described above, the folding roller 45 serves also as a conveying member and is rotated in conjunction with the bundle discharge roller during discharge of the folded sheet bundle BS.

Sheet number information of the folded sheet bundle BS can be set as follows: the number of documents set in the document feeder 15 mounted to the image forming device A is counted, and the obtained sheet number information is transmitted to a sheet center-folding controller 122 through the image forming device controller 110 for setting thereof. Alternatively, the number of sheets discharged from the main body sheet discharge port 3 is counted at predetermined intervals in the image forming device A, and the obtained count information is transmitted to the sheet processing device. Further, alternatively, an S1 sensor provided at the carry-in port 23 of the sheet processing device B is used to count the number of sheet for setting. Further, alternatively, as illustrated in FIG. 13, a shaft 45*bx* of the lower pressure contact roller 45*b* is measured by a laser displacement meter 130, and the obtained thickness information is recognized as the sheet number information so as to determine large number of sheets/small number of sheets.

The following describes, using FIGS. 14A to 14D, operation of the stepwise folding by the pressing roller unit 56 when the folded sheet bundle BS is stopped in the region R2 for the large number of sheets.

Figure 14A:
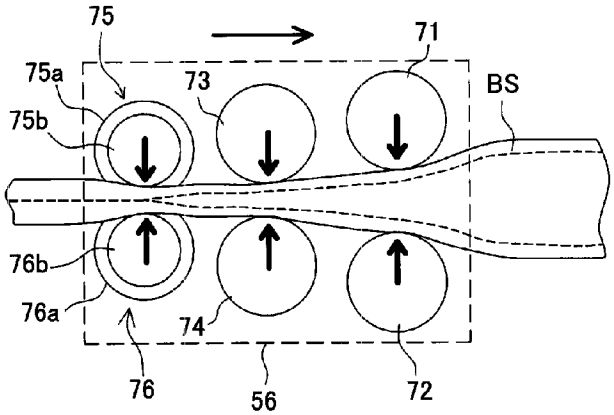
Figure 14B:
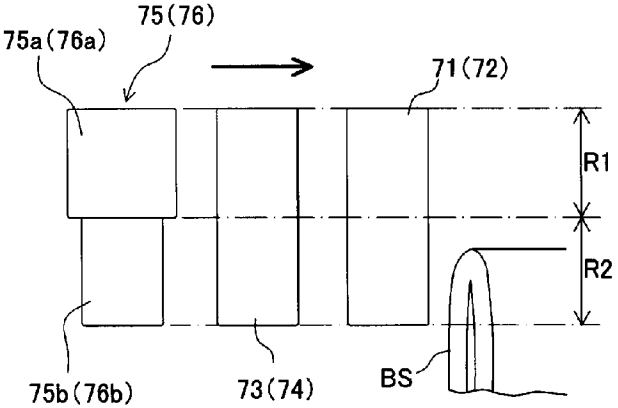

FIGS. 14A and 14B illustrate a case where the number of sheets forming the folded sheet bundle BS is large. As illustrated in FIG. 14B, the folded sheet bundle BS is stopped in the region R2 where the upper and lower pressing roller small-diameter portions 75*b* and 76*b* are opposed to each other with an interval. As described using FIGS. 8 to 10 and as illustrated in FIG. 14B, the pressing roller unit 56 supporting the pressing roller pairs of three rows having mutually different intervals among the rows is moved in an illustrated arrow direction to apply the stepwise folding to the folded sheet bundle BS stopped in this position. At this time, the third upper and lower pressing rollers 75 and 76 smoothly override the end portion of the folded sheet bundle BS formed by a large number of sheets, which is situated in the region R2 where the upper and lower pressing roller small-diameter portions 75*b* and 76*b* are opposed to each other with an interval (2 mm, in the present embodiment) with little resistance and impact. Further, the folded sheet bundle BS has a larger thickness than the interval L4 (see FIG. 7) and, therefore, the folding can be achieved surely.

Figure 14C:
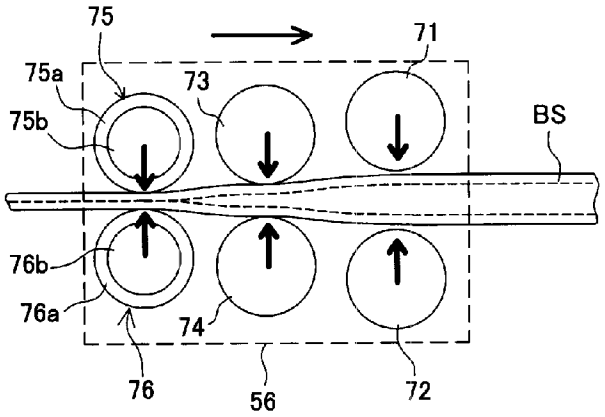
Figure 14D:
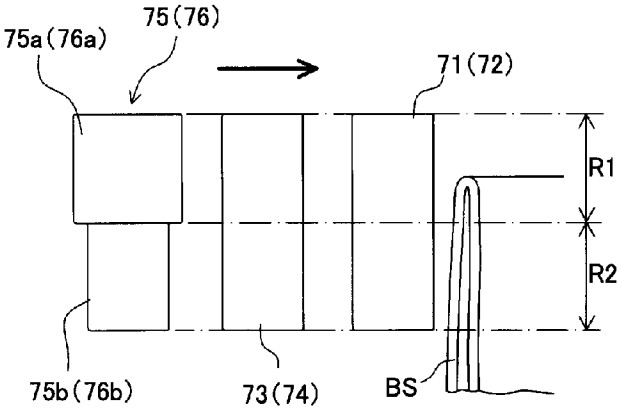

On the other hand, FIGS. 14C and 14D illustrate a case where the number of sheets forming the folded sheet bundle BS is small. As illustrated in FIG. 14D, the folded sheet bundle BS is stopped in the region R1 where the upper pressing roller large-diameter portion 75*a* and lower pressing roller large-diameter portion 76*a* are brought into pressure contact with each other without an interval. As described using FIGS. 8 to 10 and as illustrated in FIG. 14D, the pressing roller unit 56 supporting the pressing roller pairs of three rows having mutually different intervals among the rows is moved in an illustrated arrow direction to apply the stepwise folding to the folded sheet bundle BS stopped in this position. In this case, the folded sheet bundle BS is formed by a small number of sheets, so that the third upper and lower pressing rollers 75 and 76 smoothly override the end portion of the folded sheet bundle BS which is situated in the region R1 where the upper pressing roller large-diameter portion 75*a* and the lower pressing roller large-diameter portion 76*a* are brought into pressure contact with each other with little resistance and impact. Further, a fold line can surely be given by the upper pressing roller large-diameter portion 75*a* and the lower roller pressing large-diameter portion 76*a* brought into pressure contact with each other without an interval (interval L3, see FIG. 7).

Hereinafter, with reference to flowcharts of FIGS. 15 and 16, the stepwise folding as illustrated in FIGS. 14A to 14D will be described in two cases according to the steps (S): where the folded sheet bundle BS is formed by a large number of sheets (exceeding a predetermined number of sheets) and where folded sheet bundle BS is formed by a small number of sheets (equal to or less than a predetermined number of sheets).

First, the "stepwise folding mode" is designated through the control panel 18. When the "stepwise folding mode" is designated, a designated number of sheet bundles each formed by a predetermined number of sheets are created and saddle-stitched by the saddle stitching stapler 40 for each bundle. Then, the sheet bundle is folded in two by the folding roller 45 and the folding blade 46 and then conveyed to the stepwise folding unit 50 through the folded sheet conveying path BP. In this process, it is determined whether the number of sheets is equal to or less than 15 sheets (30 sheets in a folded state) or more than 15 sheets (S201). In place of the number of sheets, the large number of sheets and small number of sheets may be determined based on the thickness.

[For Small Number of Sheets]

When the folded sheet bundle BS is formed by 15 or less sheets, a drive rotation range of the folding motor 126 that rotates the folding roller 45 is set such that the folded sheet bundle BS is stopped in the region R1 illustrated in FIG. 13 and FIGS. 14A to 14D where the upper pressing roller large-diameter portion 75*a* and the lower pressing roller large-diameter portion 76*a* are brought into pressure contact with each other without an interval. After the setting, counting is performed using a counter to determine whether or not the fold (back) of the folded sheet bundle BS is situated in the region R1 between the large-diameter roller portions (S203). When it is determined that the fold of the folded sheet bundle BS is situated in the region R1, the drive rotation of the folding motor 126 is stopped (S204). In this state, the fore edge of the folded sheet bundle BS is held between the rollers of the folding roller pair 45.

Then, the unit drive motor 69 is driven in the normal direction so as to move the pressing roller unit 56 in the sheet width direction (S205). The normal direction rotation of the unit drive motor 69 causes the unit flag 107 illustrated in FIG. 5 to be separated from the home position sensor 108 (i.e., to be turned OFF). Counting is started with the separation, and the pressing roller unit 56 is moved until the count indicates that the pressing roller unit 56 has passed through the folded sheet bundle BS in the width direction (S206). When the count reaches a moving amount corresponding to the width, it is determined that the pressing has been finished, and the drive of the unit drive motor 69 is stopped (S207). With the movement of the pressing roller unit 56 in the width direction, the fold of the folded sheet bundle BS is pressed. That is, the fold of the folded sheet bundle BS is pressed stepwise as illustrated in FIGS. 11A to 11C in the stepwise folding mode. At this time, in the third upper and lower pressing rollers 75 and 76 of the last row, the fold of the folded sheet bundle BS is pressed in the region R1 where the upper pressing roller large-diameter portion 75*a* and the lower pressing roller large-diameter portion 76*a* are brought into pressure contact with each other. As a result, the fold of the folded sheet bundle BS formed by a small number of sheets is surely pressed.

In the state where the unit drive motor 69 is stopped, it is determined that the movement of the pressing roller unit 56 has been completed. That is, in this state, the pressing roller unit 56 is situated at an opposite side to the home position. This state is determined as a pressing completion state, and the folding motor 126 and the bundle discharge motor that drives the bundle discharge roller 49 as the discharge member are driven (S208). The rotations of the above motors cause the stepwise-folded folded sheet bundle BS formed by a small number of sheets to be discharged to the second sheet discharge tray 22. The completion of the discharge is detected by the bundle discharge sensor (SEN4) 131 provided near the bundle discharge roller 49. The detection of the discharge is confirmed when a state of the bundle discharge sensor (SEN4) 131 is changed from "ON" to "OFF" (S209). Upon detection of the discharge, the folding motor 126 and the bundle discharge motor that drives the bundle discharge roller 49 are stopped (S210).

After the discharge of the folded sheet bundle BS to the second sheet discharge tray 22, the unit drive motor 69 is driven in the reverse direction (S211). The reverse rotation of the unit drive motor 69 causes the pressing roller unit 56 situated at the opposite side to the home position to be moved toward the home position. The unit flag 107 attached to the pressing roller unit 56 as illustrated in FIG. 4 is detected by the home position sensor 108 (S212). By the detection, it is determined that the pressing roller unit 56 has returned to the home position, and the unit drive motor 69 is stopped (S213). In this process, presence/absence of a succeeding folded sheet bundle BS is checked (S214). When the succeeding folded sheet bundle BS is present, the processing flow returns to the start point (round mark 1 in FIG. 15), where processing is performed from S201. When the succeeding folded sheet bundle BS is absent, this routine is ended.

In the above operation flow, when the folded sheet bundle BS is discharged to the second sheet discharge tray 22 (S210), the unit drive motor 69 is driven in the reverse direction (S211) to cause the pressing roller unit 56 to return to the home position (S213). However, when the folded sheet bundle BS is formed by an extremely small number (e.g., two or three sheets) of sheets, the following configuration may be adopted. That is, the pressing roller unit 56 is not moved back to the home position immediately after the discharge of the preceding folded sheet bundle BS, but the pressing roller unit 56 is moved back to the home position after the fold (back) of the succeeding folded sheet bundle BS is positioned in the region R1. In this returning process, the pressing roller unit 56 presses the fold of the succeeding folded sheet bundle BS. Thus, discharge of the preceding folded sheet bundle BS and carry-in of the succeeding folded sheet bundle BS to the region R1 are simultaneously performed for each movement of the pressing roller unit 56 in one direction, whereby a processing speed (productivity) is further improved.

[For Large Number of Sheets]

The following describes processing to be performed when the folded sheet bundle BS is formed by a large number of sheets. Referring back to FIG. 15, when the number of sheets forming the folded sheet bundle BS exceeds 15 (S201), the drive rotation range of the folding motor 126 that rotates the folding roller 45 is set such that the folded sheet bundle BS is stopped in the region R2 illustrated in FIG. 13 and FIGS. 14A to 14D where the upper and lower pressing roller small-diameter portions 75*b* and 76*b* are opposed to each other with a slight interval, followed by driving of the folding motor 126 (S221). After the setting, it is determined based on the counter value whether or not the fold (back) of the folded sheet bundle BS is situated in the region R2 between the small-diameter portions (S222). When the fold (back) of the folded sheet bundle BS is situated in the region R2, the folding motor 126 is stopped. In this state, the fore edge of the folded sheet bundle BS is held between the rollers of the folding roller pair 45 (S223).

The subsequent steps (steps S223 to S226) are substantially the same as those in the processing for the small number of sheets, and descriptions thereof will be omitted. Different points are follows.

The first different point is that, in the third upper and lower pressing rollers 75 and 76 of the third row, the fold (back) of the folded sheet bundle BS formed by a large number of sheets is situated in the region R2 between the upper and lower pressing roller small-diameter portions 75*b* and 76*b* are opposed to each other with a slight interval. Thus, the third upper and lower pressing rollers 75 and 76 (i.e., the upper and lower pressing roller small-diameter portions 75*b* and 76*b*) can easily override even the end portion of the folded sheet bundle BS formed by a large number of sheets and thus having a large thickness. As a result, the third upper and lower pressing rollers 75 and 76 can smoothly override the fold of the folded sheet bundle BS with little resistance and impact, thereby preventing the folded sheet bundle BS from being deviated from a proper position.

The second different point is a discharge timing of the folded sheet bundle BS that has been subjected to the stepwise folding to the second sheet discharge tray. That is, for a small number of sheets, the folded sheet bundle BS that has been subjected to the stepwise folding by the pressing roller unit 56 is first discharged to the second sheet discharge tray with the pressing roller unit 56 situated at the opposite side to the home position, and then the pressing roller unit 56 is returned to the home position. On the other hand, for a large number of sheets, the pressing roller unit 56 is first moved back to the home position, and then the folded sheet bundle is discharged. Referring back to FIGS. 15 and 16, this point will be described below.

When the step-wise folding in one direction is finished by the movement of the pressing roller unit 56, the unit drive motor 69 is once stopped (S226). In this state, the folded sheet bundle BS is not discharged, but the unit drive motor 69 is driven in the reverse direction at a speed lower than that for the stepwise folding for a small number of sheets (S227). The reverse drive of the unit drive motor 69 causes the pressing roller unit 56 situated at the opposite side to the home position to be moved toward the home position at a low speed. Then, the unit flag 107 attached to the pressing roller unit 56 as illustrated in FIG. 4 is detected by the home position sensor 108 (S228). By the detection, it is determined that the pressing roller unit 56 has returned to the home position, and the unit drive motor 69 is stopped (S229).

Thus, also in this returning of the pressing roller unit 56, the fold of the folded sheet bundle BS is pressed between the upper and lower pressing roller small-diameter portions 75*b* and 76*b*. That is, the fold is pressed twice and, therefore, the folding can be achieved surely. Since it is estimated beforehand that much processing time is taken for the stepwise folding for a large number of sheets, there is no particular problem even when the folded sheet bundle BS is discharged after completion of the reciprocation of the pressing roller unit 56. Instead, importance is placed on making the folding more secure by reciprocating the pressing roller unit 56 and by making the moving speed lower than that for the stepwise folding for a small number of sheets.

On the other hand, in the case of the stepwise folding for a small number of sheets, the folded sheet bundle BS is pressed between the upper and lower pressing roller large-diameter portions 75*a* and 76*a*, the fold line can be easily given without performing additional pressing. Further, since the fast processing is required for a small number of sheets, the folded sheet bundle BS is discharged after the stepwise folding in one direction.

In the state where the unit drive motor 69 is stopped, the pressing roller unit 56 is situated at the home position. Thereafter, the folding motor 126 and the bundle discharge motor that drives the bundle discharge roller 49 are driven (S230). The rotations of the above motors cause the stepwise-folded folded sheet bundle BS formed by a large number of sheets to be discharged to the second sheet discharge tray 22. The completion of the discharge is detected by the bundle discharge sensor (SEN4) 131 provided near the bundle discharge roller 49 (S231), and the folding motor 126 and the bundle discharge motor that drives the bundle discharge roller 49 are stopped (S232).

After the discharge of the folded sheet bundle BS to the second sheet discharge tray 22, the folding motor 126 and the bundle discharge motor that drives the bundle discharge roller 49 are stopped (S232). Thereafter, the presence/absence of the succeeding folded sheet bundle BS is checked (S233). When the succeeding folded sheet bundle BS is present, the processing flow returns to the start point (round mark 1 in FIG. 15), where processing is performed from S201. When the succeeding folded sheet bundle BS is absent, this routine is ended.

As described above, in the above operation, in the case of the stepwise folding for the folded sheet bundle formed by a small number of sheets and thus having a small thickness, the folded sheet bundle BS is discharged after the movement of the pressing roller unit 56 in one direction (forward path); while in the case of the stepwise folding for the folded sheet bundle formed by a large number of sheets and thus having a large thickness, the folded sheet bundle BS is discharged after the reciprocation (backward movement) of the pressing roller unit 56. In addition, in the backward movement, the unit drive motor 69 is driven at a low speed. As a result, the folding line can be easily given to the folded sheet bundle BS having a large thickness.

[Control Configuration]

Figure 17:
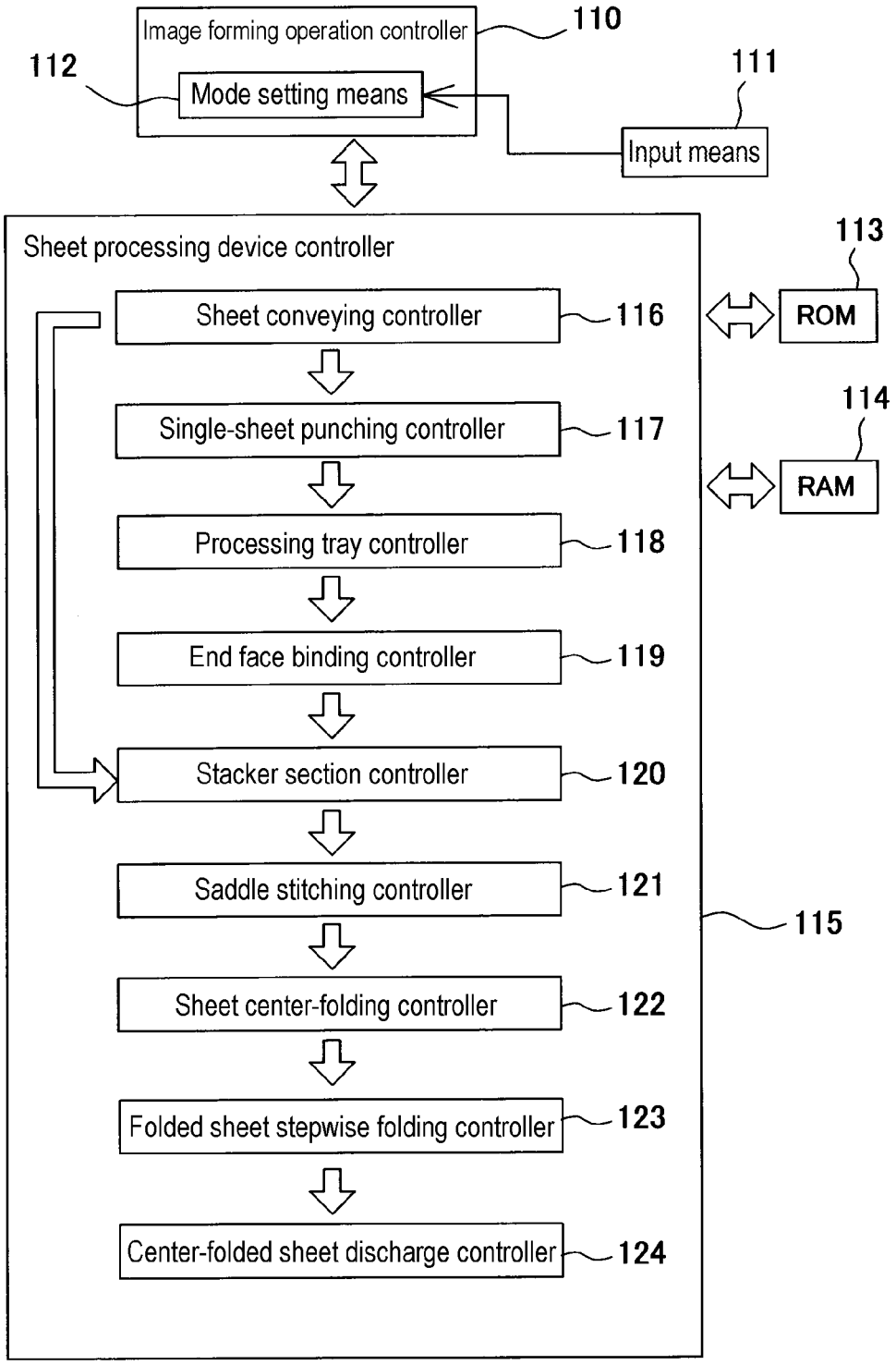
FIG. 17 is an explanatory view of a control configuration of the sheet processing device of FIG. 2.

Control configuration of the sheet processing device B provided with the thus described stepwise folding unit 50 and the image forming device A including the sheet processing device B will be described based on a block diagram of FIG. 17. An image forming device controller 110 having an image forming section 2 inputs desired processing through user's operation made to an input section 111 provided on the control panel 18. This input controls a sheet processing device controller 115 of the sheet processing device B based on a mode setting section 112.

As described above, in the sheet processing device B of the present embodiment, the following modes can be designated: (1) "print-out mode" in which the image-formed sheet is stored in a first sheet discharge tray 21; (2) "stapling mode" in which the sheets from the main body sheet discharge port 3 are aligned in a bundle, bound by the end face stapler 33, and stored in the first sheet discharge tray 21; (3) "saddle stitching and folding mode" in which the sheets from the main body sheet discharge port 3 are aligned in a bundle in the stacker section 35 which is the second processing tray, bound at a portion near a center thereof using the saddle stitching stapler 40, folded into a booklet, and stored in the second sheet discharge tray 22; and (4) "stepwise folding mode" in which a sheet loop is folded stepwise at a fold of a folded sheet bundle that has been saddle-stitched and folded into a booklet and then stored in the second sheet discharge tray 22.

The sheet processing device B includes the sheet processing device controller 115 that is made operable in one of the above modes, a ROM that stores an operation program, and a RAM that stores control data. The sheet processing device controller 115 includes a sheet conveying controller 116 that controls sheet conveyance in the device, a single-sheet punching controller 117 that applies pressing, one by one, the sheets by means of a single-sheet punching unit 28, a processing tray controller 118 that performs control of accumulating the sheets in the processing tray 29, and an end face binding controller 119 that binds the end face side of the sheets accumulated in a bundle in the processing tray 29 and discharges the bound sheet bundle.

The saddle stitching or center-folding of the sheet at about a half position thereof in the sheet conveying direction is controlled by a stacker section controller 120 that accumulates the sheet bundle in the sheet stacker section 35. The stacker section controller 120 uses the stopper 38 or aligning member 39 that regulates the leading end of the sheets carried in, one by one, to the stacker section 35 to generate an aligned sheet bundle. The sheet processing device controller 115 further includes a saddle stitching controller 121 that controls the saddle stitching stapler 40 to drive a staple or the like to a center portion of the sheet bundle and a sheet center-folding controller 122 that controls the folding blade 46 to push the saddle-stitched sheet bundle into the folding roller 45 to center-fold the sheet bundle. The sheet center-folding controller 122 is connected to the sheet bundle detection sensor (SEN3) 129 and encoder sensor 128 and uses output signals therefrom to control the folding motor 126 that drives the folding roller 45.

Further, the sheet processing device controller 115 includes a folded sheet stepwise folding controller 123 that is connected to the unit drive motor 69 that moves the pressing roller unit 56 according to the "stepwise folding mode" described above toward the folded sheet bundle BS and controls the unit drive motor 69. The folded sheet stepwise folding controller 123 is also connected to the home position sensor 108 that is used for checking whether or not the stepwise folding unit is situated at the home position.

The folded sheet bundle BS that has been subjected to the stepwise folding is discharged to and accumulated in the second sheet discharge tray under control of a center-folded sheet discharge controller 124 connected to a bundle discharge roller drive motor that drives the bundle discharge roller 49. The center-folded sheet discharge controller 124 is connected to the bundle discharge sensor (SEN4) so as to check the discharge operation of the folded sheet bundle BS.

Figure 15:
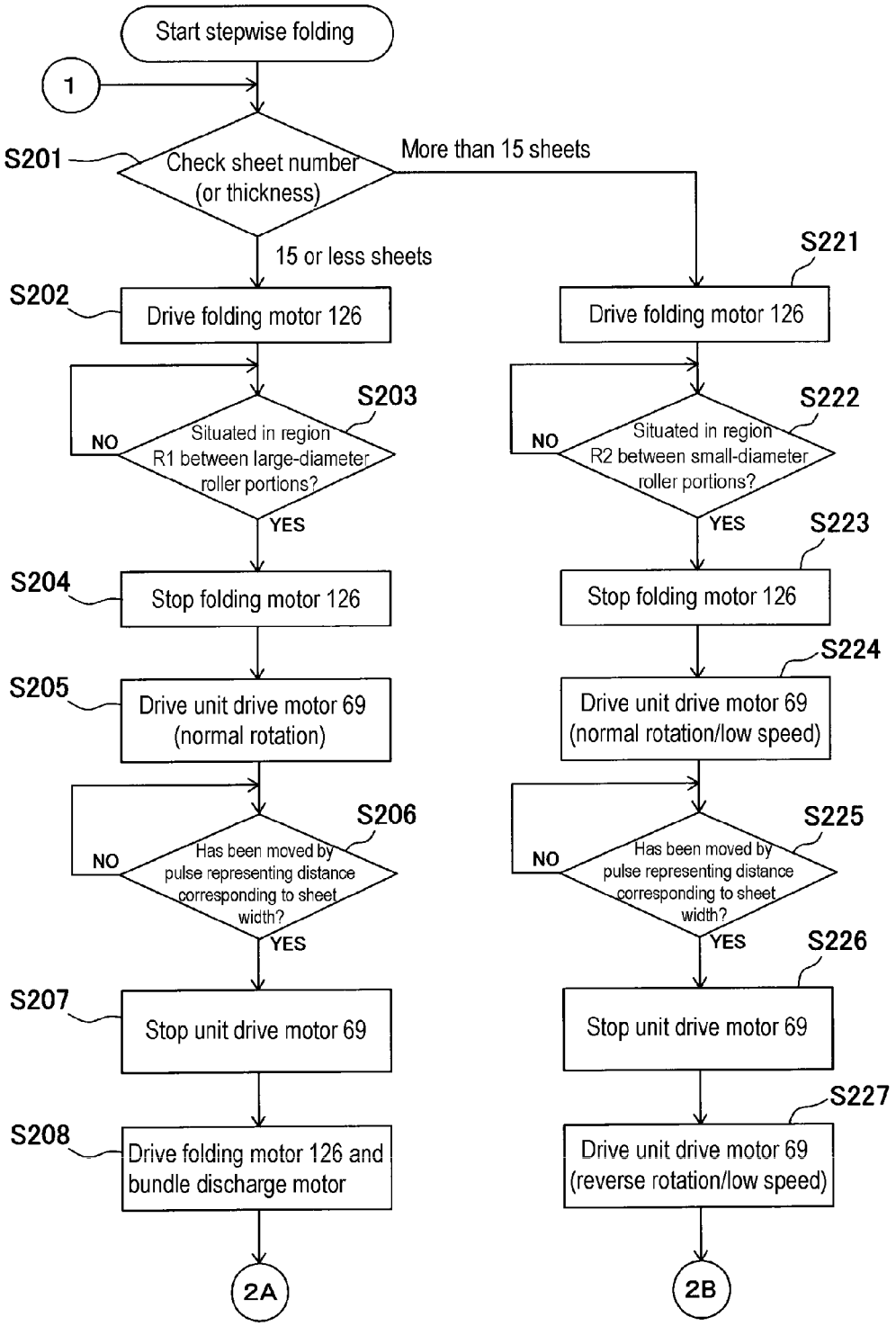
FIG. 15 is a flowchart illustrating the stepwise folding to be executed for a large number of sheets (equal to or more than a predetermined number of sheets) and a small number of sheets (less than a predetermined number of sheets)
Figure 16:
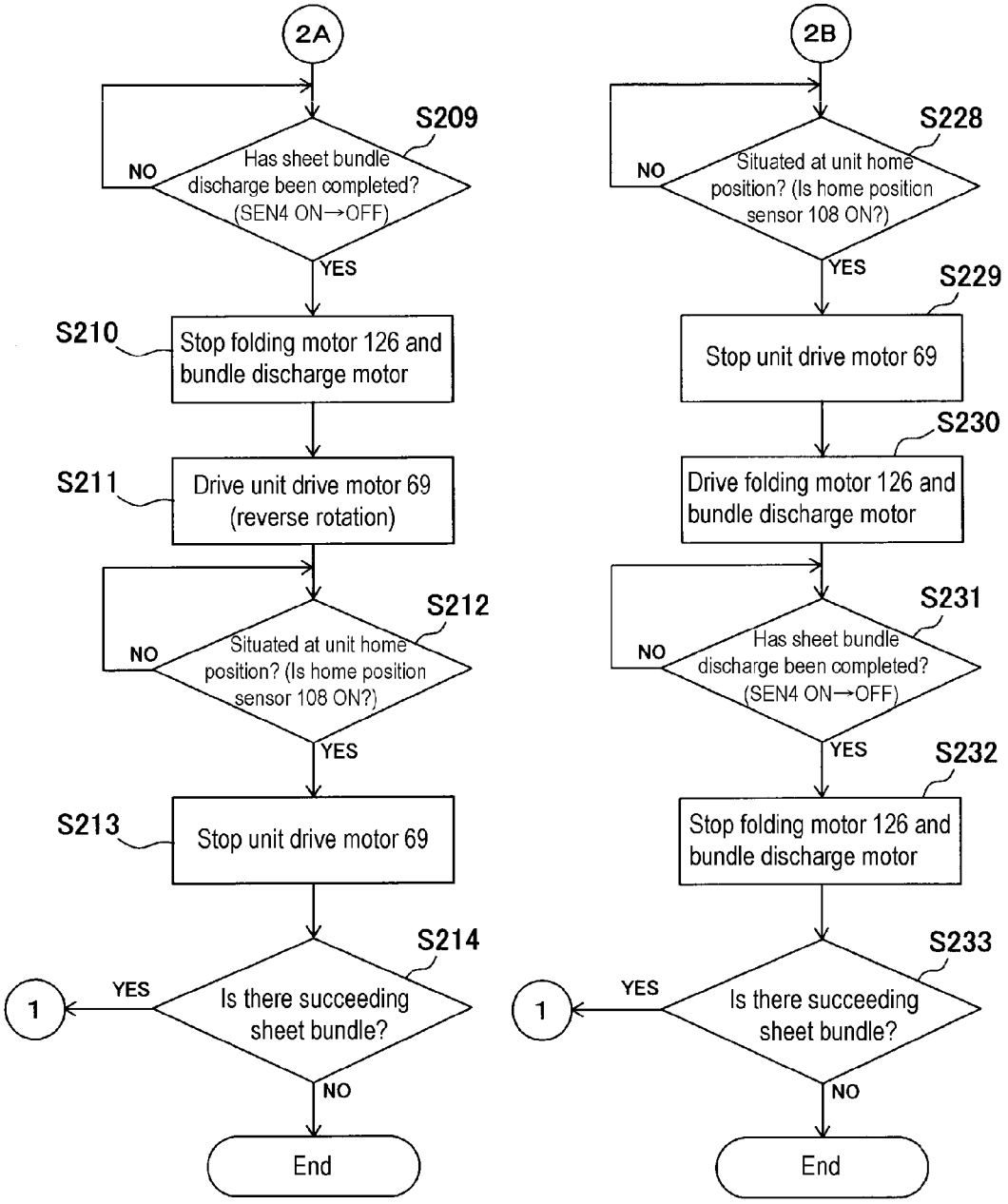
FIG. 16 is a flowchart continuing from FIG. 15.

The control of the folded sheet stepwise folding which is related especially to the present invention has been described based on the description of the respective mechanisms and using operation state explanatory views of FIGS. 8 to 10 and flowcharts of FIGS. 15 and 16, so descriptions thereof will be omitted. The stepwise folding unit 50 is controlled so as to execute a stepwise folding method based on the contents described.

The following describes modifications of the present invention. The same reference numerals are given to the members having the same functions as those in the above embodiment, and descriptions thereof will be omitted. The following first and second modifications each differ from the above embodiment in a configuration of the pressing roller unit 56 of the stepwise folding unit 50.

[First Modification]

Figure 18:
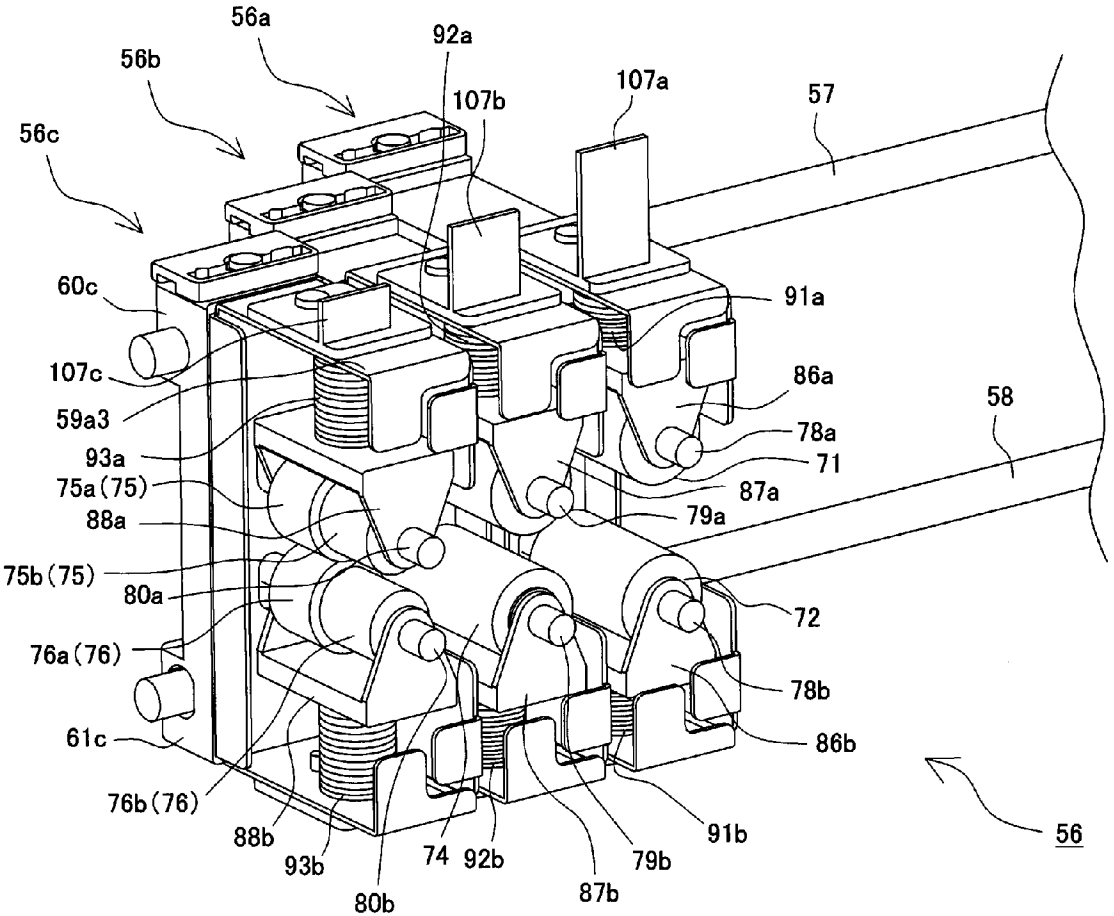
FIG. 18 is an explanatory view of a stepwise folding unit according to a first modification.

First, a first modification will be described using FIG. 18. As illustrated in detail in FIG. 6, in the above embodiment, the fold of the folded sheet bundle BS is pressed from the thickness direction of the sheet bundle by the pressing roller pairs 70 of three rows having mutually different intervals among the rows. In this case, the pressing roller unit 56 supports the pressing roller pairs 70 of three rows in one frame. On the other hand, in the first modification, as illustrated in FIG. 18, the pressing roller pairs of three rows are supported by units 56*a*, 56*b*, and 56*c*, respectively (a, b, and c are added to the reference numerals of members separated into independent units). Although not particularly illustrated, these units are connected to drive motors that independently drive the units. Thus, the units are individually moved to press stepwise the fold of the folded sheet bundle in the thickness direction of the fold. As in the case of the above embodiment, the third upper and lower pressing rollers 75 and 76 has the region R1 between the upper and lower pressing roller large-diameter portions 75*a* and 76*a* and region R2 between the upper and lower pressing roller small-diameter portions 75*b* and 76*b*.

Thus, also in the first modification, the fold of the folded sheet bundle formed by a large number of sheets is pressed in the region R2, so that the rollers can easily override the comparatively thick end portion, thereby reducing damage to be applied to the sheet end portion.

[Second Modification]

Figure 19:
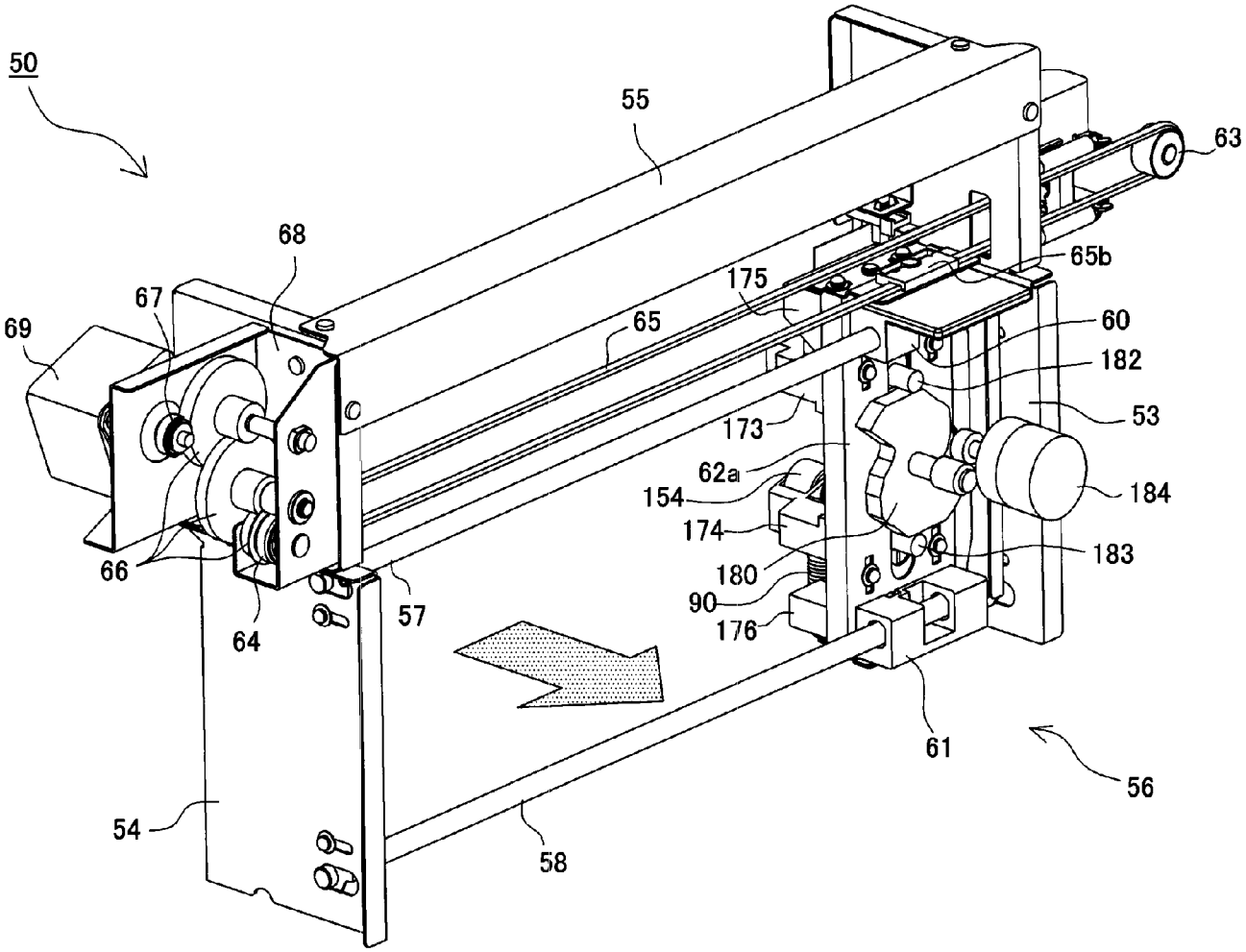
FIG. 19 is a view illustrating the entire configuration a stepwise folding unit according to a second modification.
Figure 20:
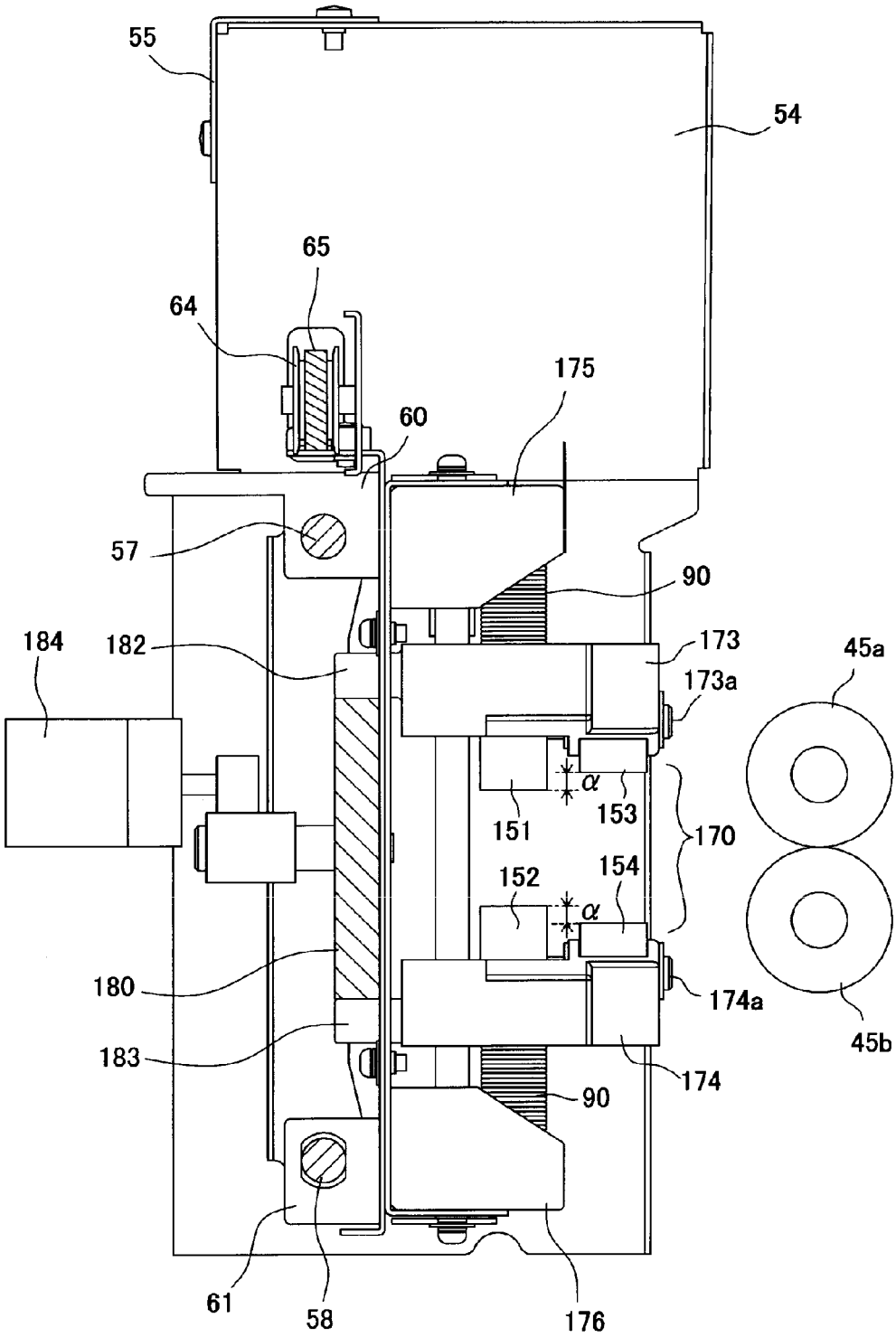
FIG. 20 is a cross-sectional view of the stepwise folding unit according to the second modification.
Figure 21:
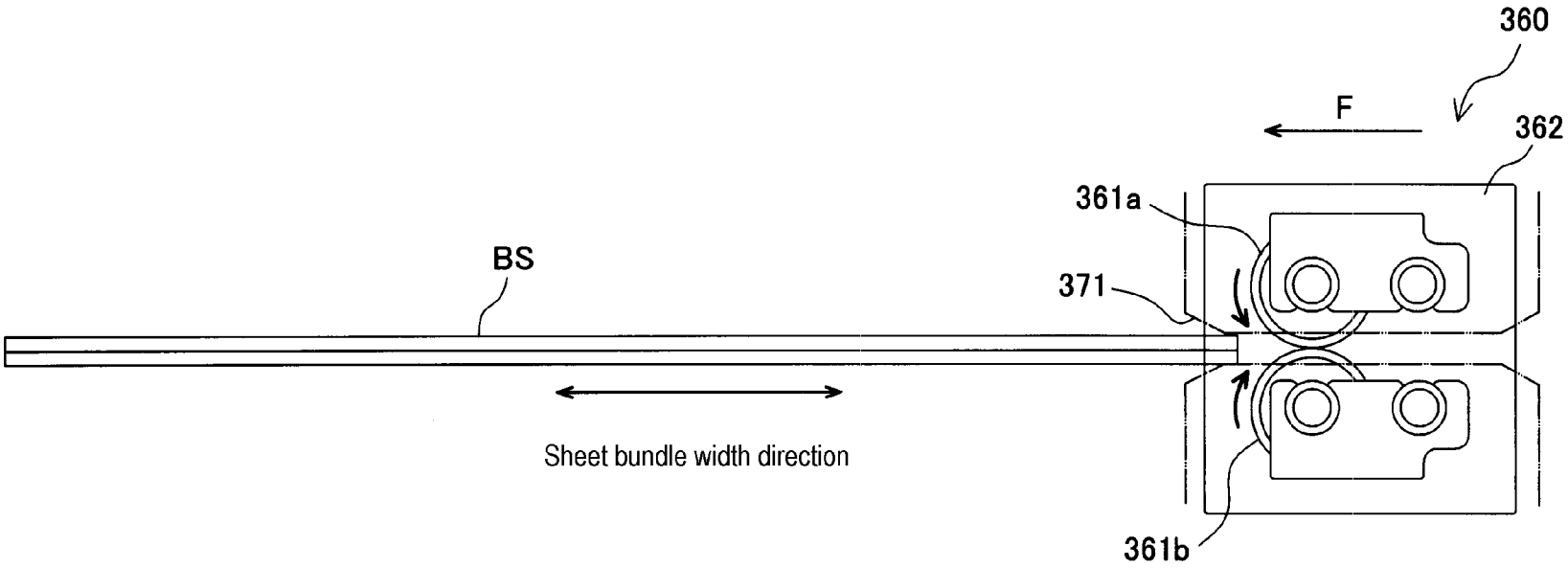
FIG. 21 is an explanatory view of a reference 1.
Figure 22A:
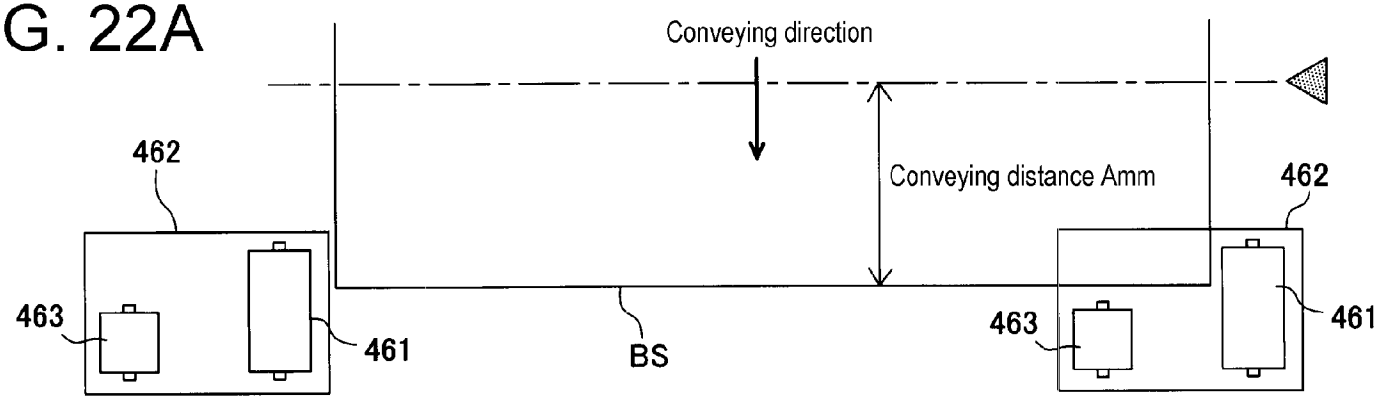
FIGS. 22A and 22B are explanatory views of a reference 2.
Figure 22B:
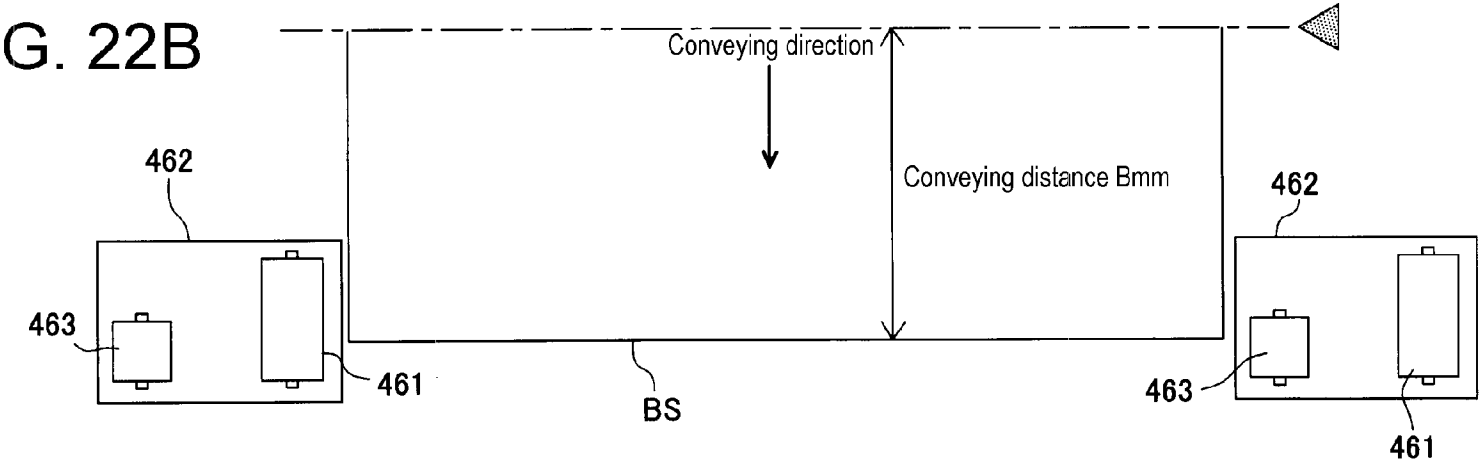
Figure 23A:
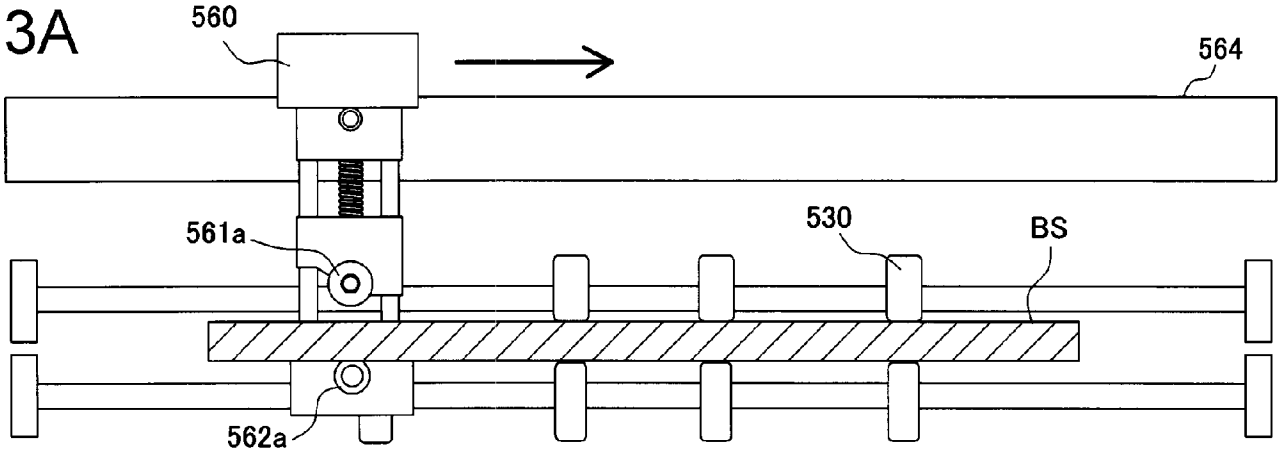
FIGS. 23A and 23B are explanatory views of a reference 3.
Figure 23B:
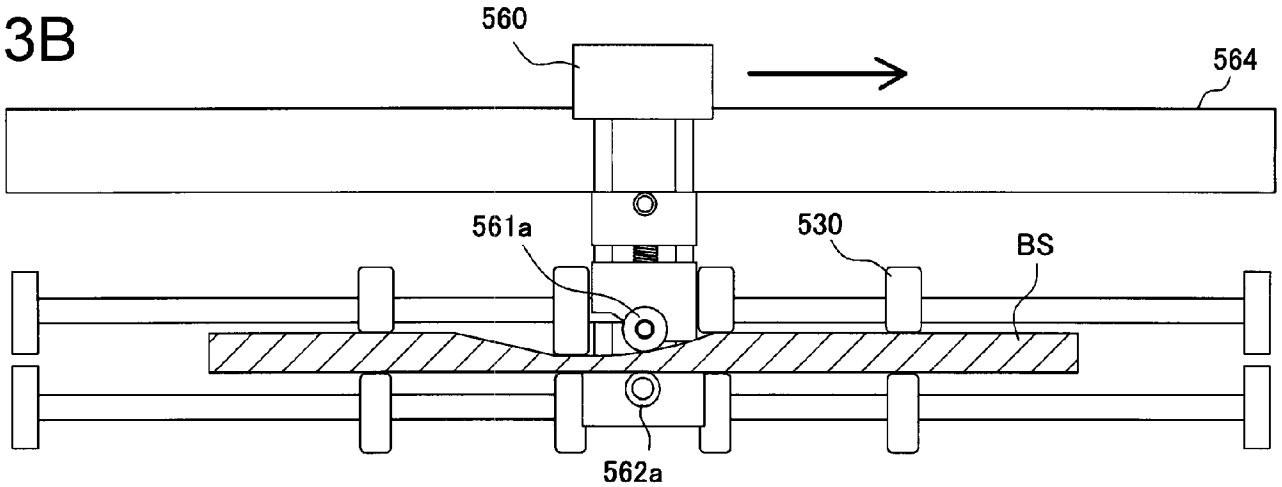

The following describes a second modification using FIGS. 19 and 20. In the embodiment and above first modification, the pressing roller pairs 70 of three rows having mutually different intervals among the rows; while in the second modification, a pressing roller 170, an interval between which is set in three stages, is configured to be moved three times (1.5 times of reciprocation) in the sheet width direction to press the fold of the folded sheet bundle.

FIG. 19 is a view viewed from the bundle discharge roller 49 side. A cam member 180 is used to set an interval between upper and lower restriction pins 182 and 183 of respective upper and lower pressing roller support blocks 173 and 174 that support the pressing roller pair 170. As illustrated in a cross-sectional view of FIG. 20, the upper and lower pressing roller support blocks 173 and 174 are biased, in such a direction that they are brought into pressure contact with each other, by pressing roller pressing springs 90 of upper and lower spring holders 175 and 176, respectively. The cam member 180 restricts the interval against the biasing force of the pressing springs 90. The cam member 180 is moved by a cam drive motor 184. The interval between the rollers of the pressing roller pair 170 can be set in three stages by the cam member 180.

Thus, in the first stage (forward movement), the fold of the folded sheet bundle is pressed by the pressing roller pair 170 set at a comparatively large interval. In the second stage (subsequent backward movement), the fold is pressed by the pressing roller pair 170 set at a second smallest interval. In the third stage, in the case of stepwise folding for the folded sheet bundle BS formed by a small number of sheets, the fold thereof is pressed in the region R1 where upper and lower pressing large-diameter rollers 151 and 152 are brought into pressure contact; in the case of stepwise folding for the folded sheet bundle BS formed by a large number of sheets, the fold is pressed in the region R2 where upper and lower pressing small-diameter rollers 153 and 154 each having a diameter smaller by a than that of the large-diameter roller are disposed at an interval. Even in this configuration, rollers can easily override the comparatively thick end portion, thereby reducing damage to be applied to the sheet end portion.

The present invention in its preferred embodiment provides the following effects.

(1) There is provided a sheet pressing device that presses a fold (BL1) of a folded sheet bundle, the device including: a pair of pressing members (pressing rollers 70) that press, in a fold thickness direction, the fold of the folded sheet bundle conveyed in a folded state; and a moving member (pressing roller unit 56) that moves the pressing member pair in a sheet fold direction while supporting the same, wherein the pressing member pair presses the fold in one of a first region where members of the pressing member pair (upper and lower pressing roller large-diameter portions 75*a* and 76*a*) are brought into pressure contact with each other and a second region adjacent to the first region on an upstream side thereof where members of the pressing member pair (upper and lower pressing roller small-diameter portions 75*b* and 76*b*) are opposed to each other at an interval.

With this configuration, the pressing member pair has the first region where members of the pressing member pair are brought into pressure contact with each other and second region where members of the pressing member pair are opposed to each other at an interval, so that it is possible to reduce impact generated when the pressing member pair abuts against the end portion of the sheet bundle and a moving load of the pressing member pair.

(2) In the sheet processing device of (1), the pressing member pair (pressing roller pair 70) integrally includes a large-diameter roller pair as the first region and a small-diameter roller pair as the second region, the large-diameter roller pair and the small-diameter roller pair being arranged in a sheet conveying direction and supported on a common axis.

With this configuration, the pressing roller pair is constituted by the large-diameter roller pair and the small-diameter roller pair which are opposed to each other, so that the stepped pressing member pair can be realized with a simple configuration.

(3) There is provided a sheet pressing device that presses a fold (BL1) of a folded sheet bundle, the device including: a conveying member (folding roller 45) that conveys a folded sheet bundle; a pair of pressing members (pressing rollers 70) that presses the sheet bundle in a fold thickness direction of the sheet bundle conveyed by the conveying member; a moving member (pressing roller unit 56) that moves the pressing member pair in a sheet fold direction; and a controller (sheet center-folding controller 122 and folded sheet stepwise folding controller 123) that controls the moving member and conveying member, wherein the pressing member pair includes a first region where members (upper and lower pressing roller large-diameter portions 75*a* and 76*a*) of the pressing member pair are brought into pressure contact with each other and a second region adjacent to the first region on an upstream side thereof where members (upper and lower pressing roller small-diameter portions 75*b* and 76*b*) of the pressing member pair are opposed to each other at an interval, and the controller controls the conveying member to set the fold of the folded sheet bundle to the first region for pressing the fold when the number of sheets forming the conveyed folded sheet bundle is equal to or less than a predetermined number and to the second region when the number of sheets forming the conveyed folded sheet bundle is more than a predetermined number.

With this configuration, when the number of sheets is equal to or less than a predetermined number, the folded sheet bundle is pressed in the region where the members of the pressing member pair are brought into pressure contact with each other, so that the folded sheet bundle formed by a small number of sheets can surely be pressed; while when the number of sheets is more than a predetermined number, the folded sheet bundle is pressed in the region where the members of the pressing member pair are opposed to each other at an interval, so that it is possible to reduce impact generated when the pressing member pair overrides on the sheet end portion, thereby reducing deformation of or damage on the sheet end portion.

(4) In the sheet processing device of (3), the pressing member pair integrally includes a large-diameter roller pair as the first region and a small-diameter roller pair as the second region, the large-diameter roller pair and the small-diameter roller pair being arranged in a sheet conveying direction and rotatably supported on a common axis.

With this configuration, the pressing roller pair is constituted by the large-diameter roller pair and the small-diameter roller pair which are opposed to each other, so that the stepped pressing member pair can be realized with a simple configuration.

(5) In the sheet processing device of (4), the conveying member serves as both a folding roller for folding a sheet bundle and a conveying roller for conveying the folded sheet bundle.

With this configuration, the folding roller for folding the sheet bundle serves also as the conveying member, thereby reducing the number of rollers to be provided.

(6) The sheet processing device of (3) further includes a discharge member (bundle discharge roller 49) that discharges the folded sheet bundle after completion of the pressing by the pressing member pair, wherein the controller (including the center-folded sheet discharge controller 124) controls, depending on the number of sheets forming the folded sheet bundle, whether to discharge the folded sheet bundle using the discharge member after one-way movement or reciprocating movement of the moving member for pressing.

With this configuration, when, particularly, the number of sheets forming the folded sheet bundle is more than a predetermined number, the fold of the folded sheet bundle is pressed in the second region where the members of the pressing member pair are separated from each other, so that when the pressing member pair supported by the moving member overrides the sheet end portion, it is possible to reduce damage on the sheet end portion caused due to abutment between the pressing member pair and the sheet end portion. Further, the moving member is reciprocated with the fold set in the second region to press the fold, thereby suppressing the folded sheet bundle from being opened after discharge.

(7) In the sheet processing device of (6), when the number of sheets forming the folded sheet bundle to be pressed by the pressing member pair is equal to or less than a predetermined number, the discharge member discharges the folded sheet bundle after completion of the one-way movement of the moving member, while when the number of sheets forming the folded sheet bundle is more than a predetermined number, the discharge member discharges the folded sheet bundle after completion of the reciprocating movement of the moving member.

With this configuration, when the number of sheets is equal to or less than a predetermined number, the folded sheet bundle is discharged after the one-way movement of the moving member, so that processing time does not become long; while when the number of sheets is more than a predetermined number, where longer processing time is accepted, it is possible to surely achieve the folding by discharging the folded sheet bundle after completion of the reciprocating movement of the moving member.

(8) In the sheet processing device of (7), the conveying member (folding roller 45) serves as both a folding roller for folding a sheet bundle and a conveying roller for conveying the folded sheet bundle and operates in conjunction with the discharging member (bundle discharge roller 49) when the folded sheet bundle is discharged.

With this configuration, the folding roller for folding the sheet bundle serves also as the conveying member and operates in conjunction with the discharging member, thereby reducing the number of rollers to be provided.

(9) In the sheet pressing device of (3), a moving speed of the moving member that is moved in the fold direction is set lower when the number of sheets forming the folded sheet bundle is more than a predetermined number than when the number of sheets forming the folded sheet bundle is equal to or less than a predetermined number.

With this configuration, when the number of sheets forming the folded sheet bundle is large, the moving member presses the fold at a comparatively low speed to thereby surely create the fold.

(10) There is provided a sheet processing device that presses a fold of a folded sheet bundle, the device including: a conveying roller (folding roller 45) that conveys a folded sheet bundle; a pair of pressing rollers (pressing rollers 70) that press the sheet bundle in a fold thickness direction of the sheet bundle; a moving unit (pressing roller unit 56) that moves the pressing roller pair in a sheet fold direction while supporting the same; and a controller (sheet center-folding controller 122 and folded sheet stepwise folding controller 123) that controls the sheet conveying operation of the conveying member and moving operation of the moving member, wherein the moving unit supports a plurality of rows of the pressing roller pairs with the intervals therebetween in the respective rows reduced stepwise in a moving direction of the moving member, the pressing roller pair of the last stage of the plurality of rows includes a first region formed by rollers of large-diameter roller pair (upper and lower pressing roller large-diameter portions 75*a* and 76*a*) which are brought into pressure contact with each other and a second region adjacent to the large-diameter roller pair on an upstream side in a sheet conveying direction, formed by rollers of small-diameter roller pair (upper and lower pressing roller small-diameter portions 75*b* and 76*b*) which are opposed to each other at an interval, and the controller controls the conveying member to set the fold of the folded sheet bundle to the first region for pressing the fold when the number of sheets forming the conveyed folded sheet bundle is equal to or less than a predetermined number and to the second region when the number of sheets forming the conveyed folded sheet bundle is more than a predetermined number.

With this configuration, when the number of sheets is equal to or less than a predetermined number, the folded sheet bundle is pressed in the region where the members of the pressing member pair are brought into pressure contact with each other, so that the folded sheet bundle formed by a small number of sheets can surely be pressed; while when the number of sheets is more than a predetermined number, the folded sheet bundle is pressed in the region where the members of the pressing member pair are opposed to each other at an interval, so that it is possible to reduce impact generated when the pressing member pair overrides on the sheet end portion, thereby reducing deformation of or damage on the sheet end portion. Further, there are provided the plurality of rows of the pressing member pairs whose intervals in the respective rows are reduced stepwise, whereby the fold of the folded sheet bundle is directed inward stepwise. Thus, the sheet bundle itself is directed to its binding direction, thereby suppressing the folded sheet bundle from being opened after the folding, which allows more sheet bundles to be accumulated.

(11) In the sheet processing device of (10), the plurality of rows of the pressing roller pairs supported in the moving unit so as to be arranged in the moving direction are configured such that two rollers constituting the sheet pressing member pair of each row are disposed opposite to each other, with a sheet fold position as a center, at positions substantially equally distant from the sheet fold position.

With this configuration, two rollers constituting the sheet pressing member pair of each row are disposed opposite to each other, with a sheet fold position as a center, at positions substantially equally distant from the sheet fold position, so that the pair of pressing rollers equally approach each other in the sheet thickness direction. Thus, the fold lines created by the pair of pressing rollers are formed at positions substantially equally distant from the sheet fold position, whereby a folded booklet having a good appearance can be created.

(12) In the sheet processing device of (10), the pressing roller pair integrally includes the large-diameter roller pair as the first region where the rollers are brought into pressure contact and the small-diameter roller pair as the second region disposed on the upstream side of the large-diameter roller pair, the large-diameter roller pair and the small-diameter roller pair being rotatably supported on a common axis.

With this configuration, the pressing roller pair is constituted by the large-diameter roller pair and the small-diameter roller pair which are opposed to each other, so that the stepped pressing member pair can be realized with a simple configuration.

(13) In the sheet processing device of (10), there are arranged at least three rows of the pressing roller pairs having mutually different intervals among the rows.

With this configuration, there are arranged three rows of the pressing roller pairs having mutually different intervals among the rows, so that it is possible to surely press the fold of the folded sheet bundle irrespective of whether the number of sheets is large or small.

(14) There is provide an image forming apparatus including: an image forming section that forms an image on a sheet; and a sheet processing device that applies predetermined sheet processing to the image-formed sheet from the image forming section, wherein the sheet processing device is the sheet processing device as claimed in claim 1.

With this configuration, there can be provided an image forming apparatus having the sheet processing device capable of providing above-described working effects.

In the description of the embodiment and the effects thereof, reference numerals are given to constituent elements recited in the claims so as to clarify a correspondence relationship between the description of "Detailed Description" and the description of "What is Claimed is".

Further, it should be appreciated that the present invention is not limited to the present embodiment, and various modifications may be made thereto. Further, all technical matters included in the technical ideas set forth in the claims should be covered by the present invention. While the invention has been described based on a preferred embodiment, those skilled in the art can realize various substitutions, corrections, modifications, or improvements may be made from the content disclosed in the specification by a person skilled in the art, which are included in the scope defined by the appended claims.

This application is based upon and claims the benefit of priority from prior Japanese Patent Applications No. 2014-241045 and No. 2014-241046, both filed Nov. 28, 2014, the entire contents of which are incorporated herein by reference.

What is claimed is:

1. A sheet pressing device that presses a fold of a folded sheet bundle comprising:

a plurality of pairs of pressing members that press, in a fold thickness direction, the fold of the folded sheet bundle being conveyed from a predetermined conveying direction in a folded state; and a moving member that moves in a moving direction crossing the conveying direction along a sheet fold direction of the folded sheet bundle while supporting the pressing member pairs, wherein the moving member supports a plurality of rows of pressing member pairs with intervals between the pressing member pairs in the respective rows reduced in the moving direction, and the pressing member pair supported in a subsequent row, in which an interval of the subsequent row is narrower than that of a precedent row in the moving direction, presses the fold in one of a first region where members of the pressing member pair are brought into pressure contact with each other or a second region adjacent to the first region on an upstream side of the conveying direction where members of the pressing member pair are opposed to each other at an interval.

2. The sheet pressing device according to claim 1, wherein the pressing member pair is a roller pair rotatable in the moving direction, and the pressing member pairs including the first and second regions integrally include a large-diameter roller pair as the first region and a small-diameter roller pair as the second region, the large-diameter roller pair and the small-diameter roller pair being arranged in the conveying direction and supported on a common axis.

3. A sheet processing device that presses a fold of a folded sheet bundle comprising:

a conveying member that conveys a folded sheet bundle in a predetermined conveying direction;

a plurality of pairs of pressing members that presses the fold of the folded sheet bundle in a fold thickness direction of the folded sheet bundle conveyed by the conveying member;

a moving member that moves the pressing member pair in a sheet fold direction of the folded sheet bundle; and a controller that controls the moving member and the conveying member, wherein the moving member supports a plurality of rows of pressing member pairs with intervals between the pressing member pairs in the respective rows reduced stepwise in the sheet fold direction, the pressing member pair in a last row in the sheet fold direction includes a first region where members of the pressing member pair are brought into pressure contact with each other and a second region adjacent to the first region on an upstream side of the conveying direction where members of the pressing member pair are opposed to each other at an interval, and the controller controls the conveying member to set the fold of the folded sheet bundle to the first region for pressing the fold when the number of sheets forming the conveyed folded sheet bundle is equal to or less than a predetermined number and to set the fold of the folded sheet bundle to the second region when the number of sheets forming the conveyed folded sheet bundle is more than a predetermined number.

4. The sheet processing device according to claim 3, wherein the each pressing member pair is a roller pair rotatable in the sheet fold direction, and the pressing member pair in the last row integrally includes a large-diameter roller pair as the first region and a small-diameter roller pair as the second region, the large-diameter roller pair and the small-diameter roller pair being arranged in the conveying direction and rotatably supported on a common axis.

5. The sheet processing device according to claim 4, wherein the conveying member serves as both a folding roller for folding a sheet bundle and a conveying roller for conveying the folded sheet bundle.

6. The sheet processing device according to claim 3, further comprising a discharge member that discharges the folded sheet bundle after completion of the pressing by the pressing member pair, wherein the controller controls, depending on the number of sheets forming the folded sheet bundle, whether to discharge the folded sheet bundle using the discharge member after one-way movement or reciprocating movement of the moving member for pressing.

7. The sheet processing device according to claim 6, wherein when the number of sheets forming the folded sheet bundle to be pressed by the pressing member pairs is equal to or less than a predetermined number, the discharge member discharges after completion of the one-way movement of the moving member, while when the number of sheets forming the folded sheet bundle is more than a predetermined number, the discharge member discharges after completion of the reciprocating movement of the moving member.

8. The sheet processing device according to claim 7, wherein the conveying member serves as both a folding roller for folding a sheet bundle and a conveying roller for conveying the folded sheet bundle and operates in conjunction with the discharging member when the folded sheet bundle is discharged.

9. The sheet processing device according to claim 3, wherein a moving speed of the moving member that is moved in the sheet fold direction is set lower when the number of sheets forming the folded sheet bundle is more than a predetermined number than when the number of sheets forming the folded sheet bundle is equal to or less than a predetermined number.

10. A sheet processing device that presses a fold of a folded sheet bundle comprising:

a conveying roller that conveys the folded sheet bundle in a predetermined conveying direction;

a plurality of pair of pressing rollers that press the fold of the folded sheet bundle in a fold thickness direction of the folded sheet bundle;

a moving unit that moves in a sheet fold direction while supporting the pressing roller pairs; and a controller that controls the sheet conveying operation of the conveying roller and the moving operation of the moving unit, wherein the moving unit supports a plurality of rows of the pressing roller pairs with the intervals therebetween in the respective rows reduced stepwise in the sheet fold direction of the moving unit, the pressing roller pair in a last row of the plurality of rows of the pressing roller pairs in the sheet fold direction includes a first region formed by rollers of large-diameter roller pair which are brought into pressure contact with each other and a second region adjacent to the large-diameter roller pair on an upstream side in the conveying direction, formed by rollers of small-diameter roller pair which are opposed to each other at an interval, and the controller controls the conveying roller to set the fold of the folded sheet bundle to the first region for pressing the fold when the number of sheets forming the conveyed folded sheet bundle is equal to or less than a predetermined number and to the second region when the number of sheets forming the conveyed folded sheet bundle is more than a predetermined number.

11. The sheet processing device according to claim 10, wherein the plurality of rows of the pressing roller pairs supported in the moving unit so as to be arranged along the sheet fold direction is configured such that two rollers constituting the pressing roller pair of each row are disposed opposite to each other, with a sheet fold position as a center, at positions substantially equally distant from the sheet fold position.

12. The sheet processing device according to claim 10, wherein one of the pressing roller pairs integrally include the large-diameter roller pair as the first region where the rollers are brought into pressure contact and the small-diameter roller pair as the second region disposed on the upstream side of the large-diameter roller pair, the large-diameter roller pair and the small-diameter roller pair being rotatably supported on a common axis.

13. The sheet processing device according to claim 10, wherein the moving unit is arranged with at least three rows of the pressing roller pairs having mutually different intervals among the rows.

14. An image forming apparatus comprising:

an image forming section that forms an image on a sheet; and a sheet processing device that applies predetermined sheet processing to the image-formed sheet from the image forming section, wherein the sheet processing device is the sheet pressing device as claimed in claim 1.

15. A sheet pressing device that presses a fold of a folded sheet bundle comprising:

a plurality of pairs of pressing members that press, in a fold thickness direction, the fold of the folded sheet bundle conveyed from a predetermined conveying direction in a folded state; and a moving member that moves along a sheet fold direction of the folded sheet bundle while supporting the pressing member pairs, wherein the moving member includes a plurality of frames each supporting a corresponding pressing member pair, an interval between pressing members supported by each of the frames being reduced stepwise along the sheet fold direction, and the pressing member pair supported in a subsequent frame, in which the interval in the subsequent frame is narrower than that in a precedent frame in the sheet fold direction, presses the fold in one of a first region where members of the pressing member pair are brought into pressure contact with each other or a second region adjacent to the first legion on an upstream side in the conveying direction where members of the pressing member pair are opposed to each other at an interval.

16. The sheet pressing device according to claim 15, wherein the pressing member pair including the first and second regions integrally includes a large-diameter roller pair as the first region and a small-diameter roller pair as the second region, the large-diameter roller pair and the small-diameter roller pair being arranged in the conveying direction and supported on a common axis.

17. A sheet pressing device that presses a fold of a folded sheet bundle comprising:

a plurality of pairs of pressing members that press, in a fold thickness direction, the fold of the folded sheet bundle conveyed from a predetermined conveying direction in a folded state; and a moving member that moves along a sheet fold direction of the folded sheet bundle while supporting the pressing member pairs, wherein the moving member includes an interval regulating member that reduces an interval between the pressing member pairs in accordance with the sheet fold direction, and in a subsequent movement toward the sheet fold direction with the reduced interval, the pressing member pair presses the fold in one of a first region where members of the pressing member pair are brought into pressure contact with each other or a second region adjacent to the first region on an upstream side in the conveying direction where members of the pressing member pair are opposed to each other at an interval.

18. The sheet pressing device according to claim 17, wherein the pressing member pair integrally includes a large-diameter roller pair as the first region and a small-diameter roller pair as the second region, the large-diameter roller pair and the small-diameter roller pair being arranged in the conveying direction and supported on a common axis.

* * * * *